US011542737B1

(12) United States Patent
Shields et al.

(10) Patent No.: US 11,542,737 B1
(45) **Date of Patent: *Jan. 3, 2023**

(54) LIGATURE-RESISTANT HINGE CAP

(71) Applicant: Schlage Lock Company LLC, Carmel, IN (US)

(72) Inventors: Maria Shields, Indianapolis, IN (US); Gregory W. Dole, Jr., Indianapolis, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/380,613

(22) Filed: Jul. 20, 2021

(51) Int. Cl.
*E05D 11/00* (2006.01)
*E06B 1/52* (2006.01)
*E05D 7/00* (2006.01)

(52) U.S. Cl.
CPC ..... *E05D 11/0054* (2013.01); *E05D 7/00* (2013.01); *E06B 1/52* (2013.01); *E05D 2011/0072* (2013.01); *E05Y 2800/424* (2013.01); *E05Y 2900/132* (2013.01)

(58) Field of Classification Search
CPC ..... E05D 11/0054; E05D 2011/0063; E05D 2011/0072; E05D 3/122; E05D 1/00; E05D 7/009; E05D 7/00; E05C 17/54; E05Y 2900/132; E05Y 2800/40; E05Y 2800/41; E05Y 2800/424; Y10T 16/533; Y10T 16/5335; E06B 1/52
See application file for complete search history.

(56) References Cited

U.S. PATENT DOCUMENTS 2,047,909 A * 7/1936 North ..... E05D 3/02 16/250
3,206,792 A * 9/1965 Beck ..... E05D 3/02 16/250
3,431,590 A * 3/1969 Anderson ..... E05D 11/00 16/385
3,621,512 A * 11/1971 Johnson ..... E05D 5/128 16/380

(Continued)

FOREIGN PATENT DOCUMENTS

DE 20017814 U1 * 3/2001 ..... E05D 11/0054
GB 2528545 A 1/2016
GB 2470033 A 7/2019

OTHER PUBLICATIONS

Phoenix; Anti-Ligature, Architectural and Continuous Hinges; Technical Specification—Issue 1; Copyright 2011 Cooke Brothers Ltd.; 4 pages.

(Continued)

*Primary Examiner* — Chuck Y Mah
(74) *Attorney, Agent, or Firm* — Taft Stettinius & Hollister LLP

(57) ABSTRACT

A ligature-resistant hinge cap according to certain embodiments is configured for use with a hinge including a pair of leaves and a connecting portion connecting the pair of leaves. The ligature-resistant hinge cap generally includes a body portion comprising a base configured to cover an upper face of the connecting portion, a flange extending rearward from the body portion, a rear side defined by the flange, and a front side opposite the rear side, wherein the front side is sloped.

35 Claims, 18 Drawing Sheets

(56) References Cited

U.S. PATENT DOCUMENTS

| | | | | |
|---|---|---|---|---|
| 5,149,575 | A * | 9/1992 | Soifer | A47B 95/043 52/287.1 |
| 5,991,975 | A | 11/1999 | Baer | |
| 6,735,821 | B1 * | 5/2004 | Christman, Jr. | E05D 11/0054 16/250 |
| 6,883,205 | B2 * | 4/2005 | Martinez-Munoz | E05D 11/0054 16/250 |
| 9,328,546 | B1 | 5/2016 | Davis | |
| RE46,240 | E | 12/2016 | Schau | |
| RE46,280 | E | 1/2017 | Lee et al. | |
| 10,385,598 | B2 | 8/2019 | Shah et al. | |
| 11,002,050 | B1 | 5/2021 | Wolthuis et al. | |
| 2011/0030168 | A1 | 2/2011 | Schau | |
| 2011/0174026 | A1 * | 7/2011 | Salvatore | E05B 1/003 70/91 |
| 2011/0315245 | A1 * | 12/2011 | Neagoe | E03C 1/04 222/173 |
| 2020/0102776 | A1 | 4/2020 | Eshuis | |
| 2021/0127832 | A1 | 5/2021 | Shahzad | |

OTHER PUBLICATIONS

Select Hinges; Increase Safety with SELECT'S Tipit Ligature-Resistant Hospital Tip and Increase Safety with SELECT'S Ligature-Resistant Hospital Tip for New Construction; Copyright 2013 SELECT Products Limited; 2 pages.

Lock Depot; 027XY-US28-95-HT Ives Full Mortise Continuous Geared Hinges with Hospital Tip in Satin Aluminum; accessed Dec. 28, 2020; 4 pages.

Kingsway Group; KG200 Continuous Hinge; Product Datasheet; 1 page.

Select Hinges; SELECT Hospital Tips; Fast, Ligature-Resistant Solutions for Doorways Throughout Your Facility; Copyright 2020 SELECT Products Limited; 5 pages.

* cited by examiner

LIGATURE-RESISTANT HINGE CAP

TECHNICAL FIELD

The present disclosure generally relates to hinge caps, and more particularly but not exclusively relates to hinge caps for use in hospital and mental health institutions.

BACKGROUND

One danger facing patients and/or residents of hospitals, mental health institutions, juvenile detention centers, and other facilities is the possibility of self-harm. While self-harm can come in many forms, one common form is by hanging oneself via a ligature attached to a sturdy object, such as a door hardware component. Many facilities attempt to prevent this type of self-harm by reducing the number of surfaces to which such a ligature can be attached, for example by providing the hinges of the door with a sloped cap that inhibits ligatures from being wrapped about the hinge. However, many such ligature-resistant caps suffer from drawbacks and limitations, such as by providing one or more anchor points by which a ligature can be hung from the cap. For these reasons among others, there remains a need for further improvements in this technological field.

SUMMARY

A ligature-resistant hinge cap according to certain embodiments is configured for use with a hinge including a pair of leaves and a connecting portion connecting the pair of leaves. The ligature-resistant hinge cap generally includes a body portion comprising a base configured to cover an upper face of the connecting portion, a flange extending rearward from the body portion, a rear side defined by the flange, and a front side opposite the rear side, wherein the front side is sloped. Further embodiments, forms, features, and aspects of the present application shall become apparent from the description and figures provided herewith.

DETAILED DESCRIPTION OF ILLUSTRATIVE EMBODIMENTS

Figure 1:
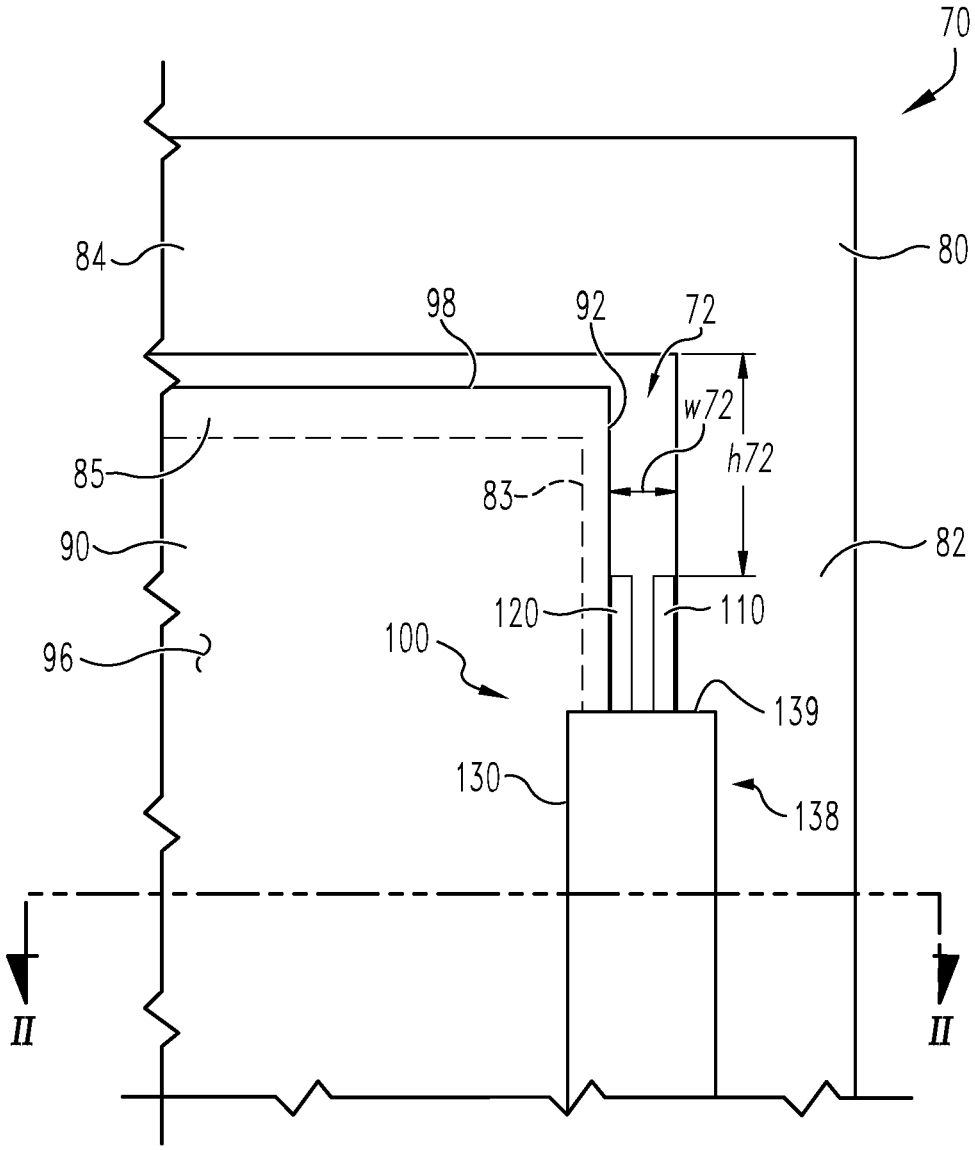
FIG. 1 is a front view of a closure assembly according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

With reference to FIG. 1, illustrated therein is a closure assembly 70 according to certain embodiments. The closure assembly 70 generally includes a doorframe 80, a door 90 pivotably mounted to the frame 80, and a hinge 100 by which the door 90 is pivotably mounted to the frame 80. The doorframe 80 generally includes a vertical hinge jamb 82, a horizontal head 84 extending from the hinge jamb 82, and a vertical latch jamb extending downward from the head 84 parallel to the hinge jamb 82. A hinge jamb stop 83 extends from the hinge jamb 82, and a head stop 85 extends from the head 84. As described herein, the stops 83, 85 provide a stop surface against which a face of the door 90 may abut when the door 90 is in its closed position.

Figure 2:
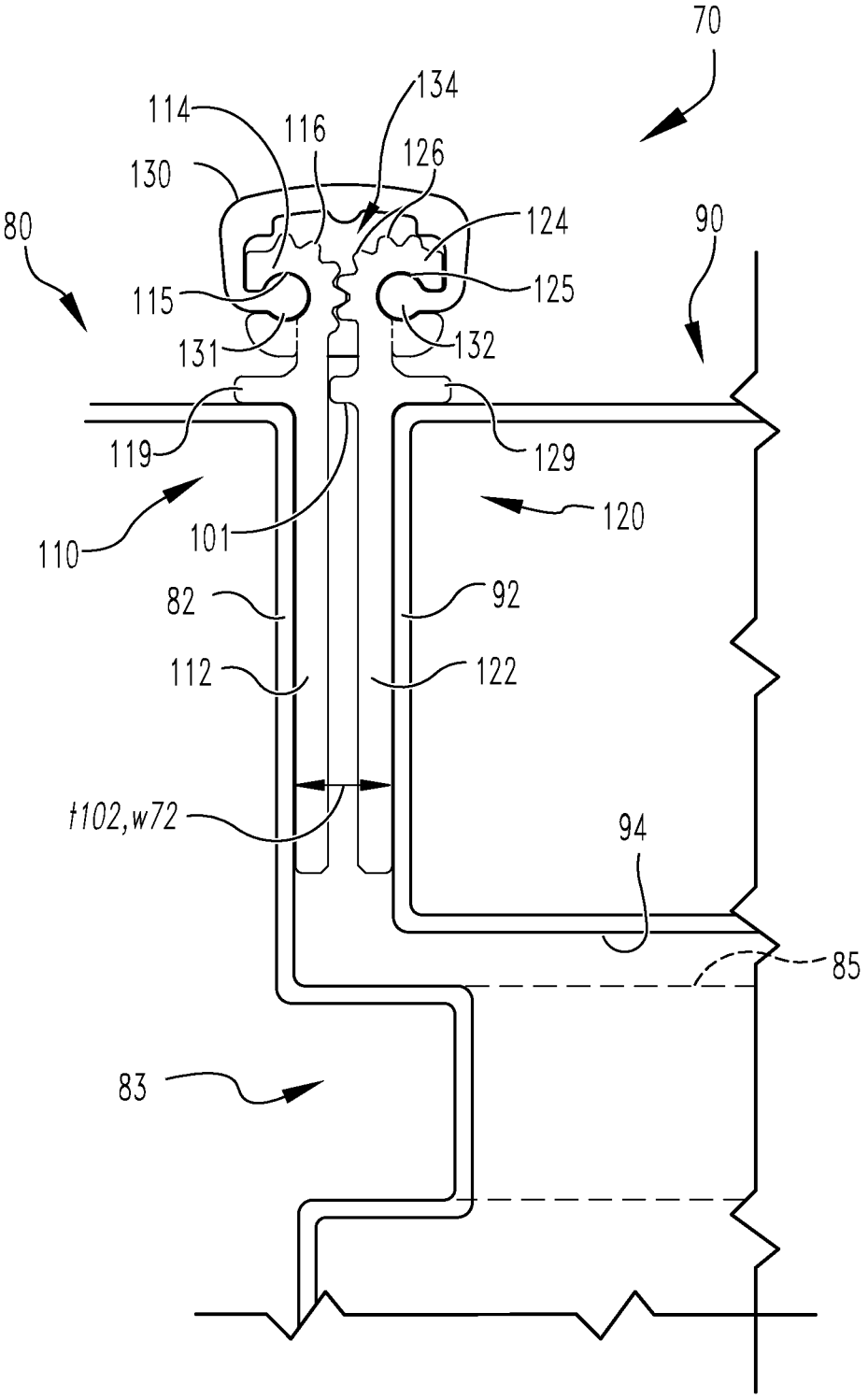
FIG. 2 is a cross-sectional illustration of the closure assembly illustrated in FIG. 1.

With additional reference to FIG. 2, the door 90 generally includes a vertical hinge edge 92 that extends between and connects a first broad face 94 and a second broad face 96 opposite the first broad face 96. The door 90 also includes a horizontal top edge 98 that extends between and connects the vertical broad faces 94, 96. When the door 90 is in its closed position, the hinge edge 92 faces the hinge jamb 82, and an upper portion of the first broad face 94 faces the head stop 85. Additionally, an open space or gap 72 is formed between the frame 80, the door 90, and the hinge 100.

The hinge 100 generally includes a frame-side first leaf 110, a door-side second leaf 120, and a connecting portion 130 hingedly connecting the first leaf 110 and the second leaf 120. With the closure assembly 70 assembled, the frame-side first leaf 110 is secured to the hinge jamb 82 of the frame 80, the door-side second leaf 120 is secured to the hinge edge 92 of the door 90, and the connecting portion 130 facilitates hinged movement of the door-side second leaf 120 and the door 90 relative to the frame-side first leaf 110 and the frame 80. In the illustrated form, the hinge 100 is provided in the form known in the art as a continuous hinge, in which the connecting portion 130 extends continuously along the longitudinal length of the hinge 100 and covers the portions that are hingedly interconnected. It is also contemplated that the hinge 100 may be provided in another form, such as a traditional form in which interleaved knuckles receive a hinge pin.

The frame-side first leaf 110 extends vertically along the hinge jamb 82 of the frame 80, and generally includes a plate portion 112 configured for mounting to the hinge jamb 82 and a body portion 114 from which the plate portion 112 extends, and may further include one or more projections 119 positioned between the plate portion 112 and the body portion 114. The plate portion 112 may include one or more apertures 113 for receiving fasteners (e.g., screws) by which the plate portion 112 is or can be secured to the hinge jamb 82. The body portion 114 is at least partially received within a channel 134 of the connecting portion 130, and is generally arcuate in geometry. A radially-inner side of the body portion 114 defines a longitudinally-extending groove 115, and a radially-outer side of the body portion 114 may define a set of gear teeth 116. The projection 119 is configured to abut the front surface of the hinge jamb 82 to ensure that the first leaf 110 is properly seated and aligned relative to the hinge jamb 82.

The door-side second leaf 120 extends vertically along the hinge edge 92 of the door 90, and generally includes a plate portion 122 configured for mounting to the hinge edge 92 and a body portion 124 from which the plate portion 122 extends, and may further include one or more projections 129 positioned between the plate portion 122 and the body portion 124. The plate portion 122 may include one or more apertures 123 (FIG. 8) for receiving fasteners (e.g., screws) by which the plate portion 122 is or can be secured to the hinge edge 92. The body portion 124 is at least partially received within the channel 134 of the connecting portion 130, and is generally arcuate in geometry. A radially-inner side of the body portion 124 defines a longitudinally-extending groove 125, and a radially-outer side of the body portion 124 may define a set of gear teeth 126 that mesh with the gear teeth 116 of the first leaf 110. The projection 129 is configured to abut the second face 96 adjacent the hinge edge 92 to ensure that the second leaf 120 is properly seated and aligned relative to the door 90.

The connecting portion 130 defines the channel 134, and further includes a pair of longitudinally-extending rails 131, 132, each of which is received in the groove 115/125 of a corresponding one of the leaves 110, 120. More particularly, a first rail 131 is received in the groove 115 of the first leaf 110 such that the first leaf 110 is pivotably coupled to the connecting portion 130, and a second rail 132 is received in the groove 125 of the second leaf 120 such that the second leaf 120 is pivotably coupled to the connection portion 130. As the door 90 pivots relative to the frame 80 between its open position and its closed position, the meshed gear teeth 116, 126 ensure that the connecting portion 130 pivots relative to the frame 80 and the door 90. In the illustrated form, the connecting portion 130 is provided as a channel member, and may alternatively be referred to as the channel member 130. In other embodiments, the connecting portion 130 may be defined at least in part by one or more of the leaves 110, 120. For example, the connecting portion 130 may be defined as a set of interleaved knuckles through which a hinge pin passes. The connecting portion 130 includes an upper end 138 that defines an upper face 139 of the connecting portion 130. As described herein, anti-ligature hinge caps according to certain embodiments are configured to cover the upper face 139 to discourage the hanging of ligatures from the connecting portion 130.

In the illustrated form, the hinge 100 further includes an additional projection 101 that discourages or prevents the plate portions 112, 122 from being flush with one another when the door 90 is in its closed position. While the illustrated additional projection 101 is formed on the second leaf 120, it is also contemplated that the additional projection 101 may be formed on the first leaf 110. It is further contemplated that the additional projection 101 may be omitted, in which case the plate portions 112, 122 may be flush with one another when the door 90 is in its closed position.

As will be appreciated, the hinge 100 has an open state corresponding to the open position of the door 90 and a closed state corresponding to the closed position of the door 90. In the closed state, the leaves 110, 120 face one another and define a thickness dimension t102 spanning between the outward-facing surfaces of the plate portions 112, 122. Those skilled in the art will readily appreciate that the thickness dimension t102 corresponds to the width dimension w72 of the gap 72 that is formed when the door 90 is in its closed position. The gap 72 also has a height dimension h72, which in the illustrated form is defined between the upper edges of the plate portions 112, 122 and the lower face of the head 84. It is also contemplated that the height dimension h72 may be measured from the upper edges of the plate portions 112, 122 to the top edge 98 of the door 90.

Figure 4:
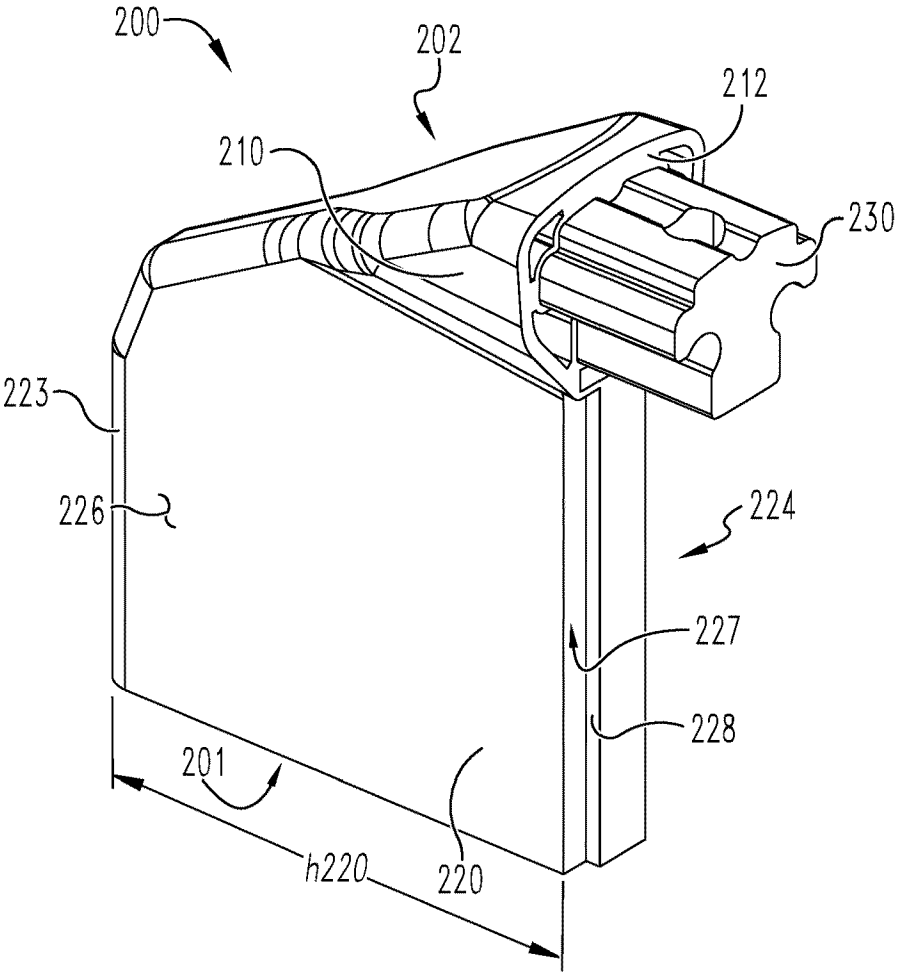
FIG. 4 is a second perspective view of the anti-ligature hinge cap illustrated in FIG. 3.
Figure 3:
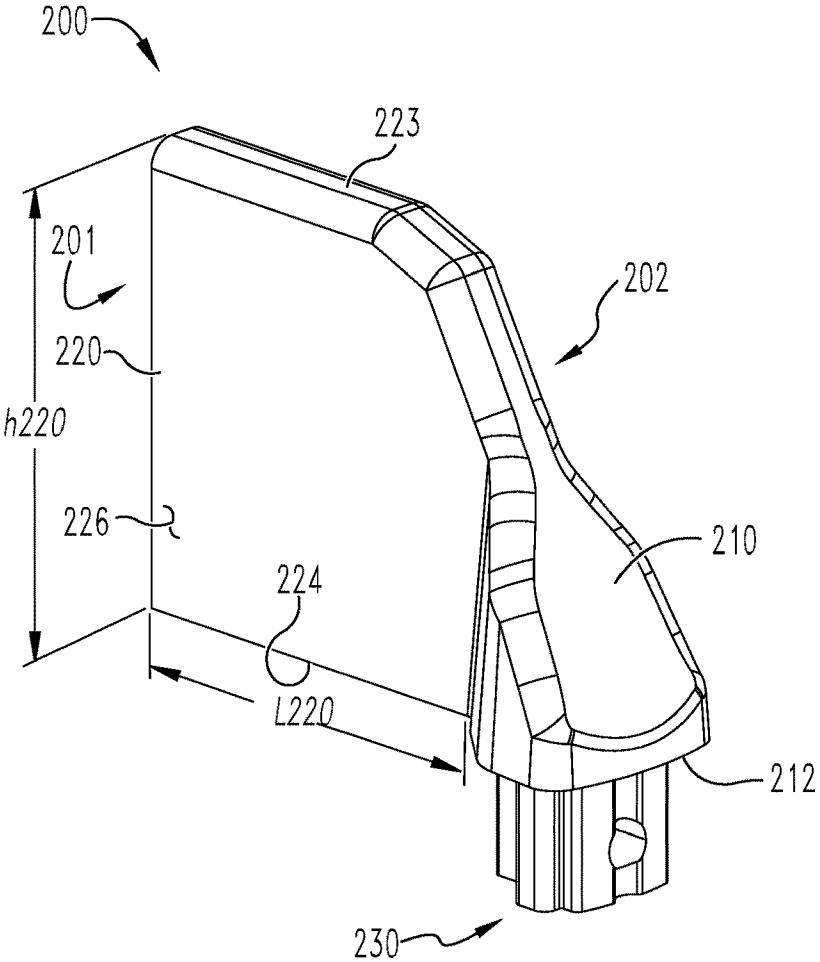
FIG. 3 is a first perspective view of an anti-ligature hinge cap according to certain embodiments.

With additional reference to FIGS. 3 and 4, illustrated therein is a ligature-resistant hinge cap 200 according to certain embodiments. The hinge cap 200 generally includes a body portion 210, a flange 220 extending rearwardly from the body portion 210, and a stem 230 extending downward from the body portion 210. In certain embodiments, the body portion 210 may be considered to include the stem 230. The hinge cap 200 also includes a rear side 201 that is defined by the flange 220 and an opposite front side 202 that is sloped.

Figure 5:
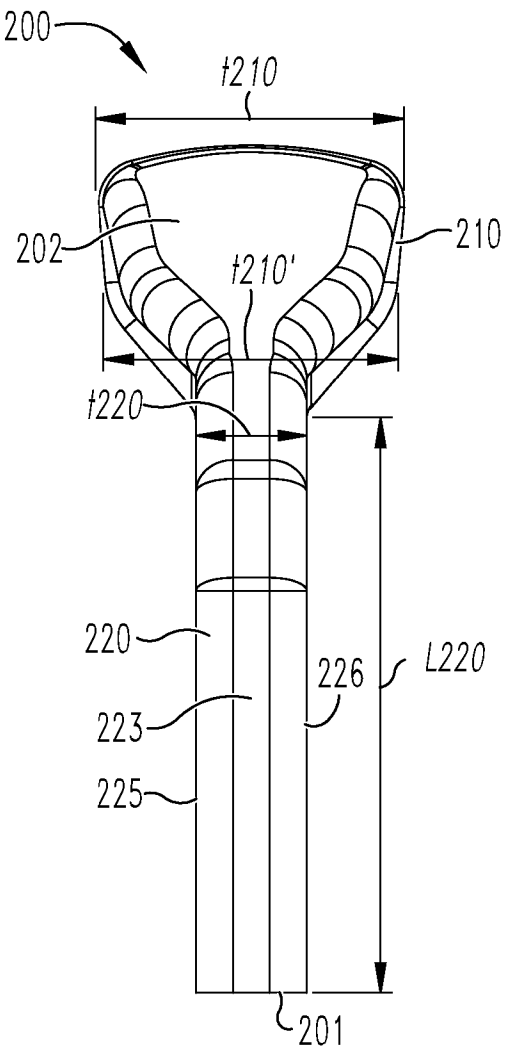
FIG. 5 is a top-down view of the anti-ligature hinge cap illustrated in FIG. 3.

With additional reference to FIG. 5, the body portion 210 is configured for mounting to the upper end 138 of the channel member 130, and at least partially defines the sloped front side 202 of the hinge cap 200. The body portion 210 includes a base 212 from which the stem 230 extends, and the base 212 has a geometry that generally corresponds to that of upper face 139 of the connecting portion 130 such that when the hinge cap 200 is mounted to the hinge 100, the base 212 is substantially flush with the upper face 139 of the channel member 130. For example, a portion of the body portion 210 may have a body portion thickness dimension t210 that corresponds to the width of the channel member 130, and the base 212 tapers from this first thickness dimension t210 to a second thickness dimension t210' corresponding to the minimum width of the upper face 139 of the channel member 130.

The flange 220 is sized and shaped to substantially fill the gap 72 in order to discourage or prevent the insertion of ligatures into the gap 72. As such, various dimensions of the flange 220 are selected to correspond to corresponding and respective dimensions of the gap 72. For example, the flange 220 has a length L220 that corresponds to the depth d72 of the gap 72, a thickness t220 that corresponds to the width w72 of the gap 72, and a height h220 that corresponds to the height h72 of the gap 72.

The flange 220 has rear side 221 that defines the rear side 201 of the hinge cap 200, a front side 222 that at least partially defines the front side 202 of the hinge cap 200, an upper side 223, a lower side 224 opposite the upper side 223, a jamb-facing first broad face 225, and a door-facing second broad face 226 opposite the first broad face 225. The length L220 of the flange 220 extends from the location that the body portion 210 meets the flange 220 to the rear side 221. The thickness t220 of the flange 220 extends between the first broad face 225 and the second broad face 226, and the hinge cap 200 tapers from the second thickness dimension t210' to the flange thickness t220. The height h220 of the flange 220 extends between the upper side 223 and the lower side 224. In certain forms, the lower side 224 may include an undercut 227 that is partially defined by a shoulder 228. The undercut 227 may be sized and shaped to allow for clearance with the hinge leaf and to prevent or discourage a pinching or binding condition between the hinge leaves 110, 120.

Figure 6:
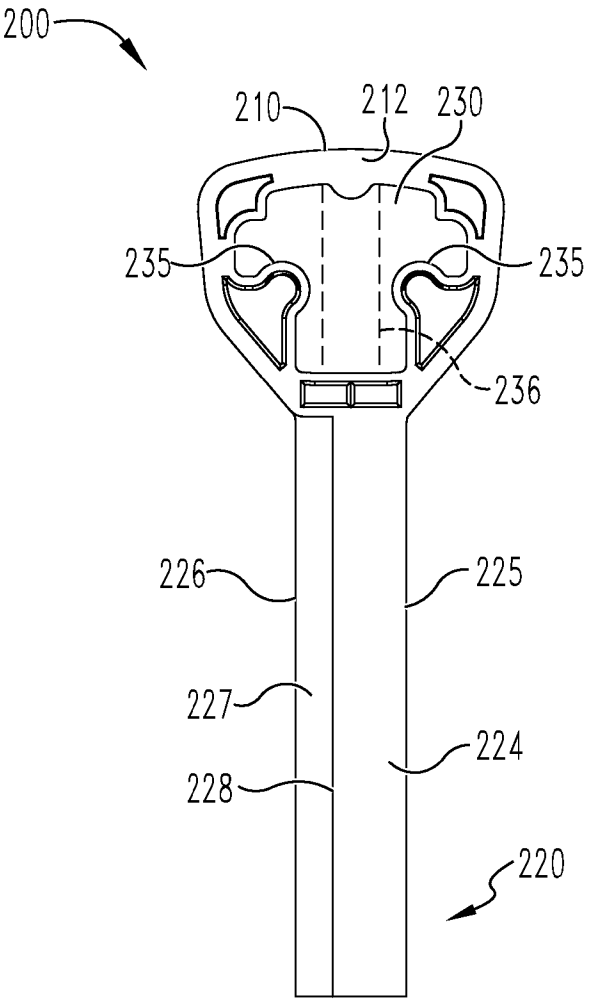
FIG. 6 is a bottom-up view of the anti-ligature hinge cap illustrated in FIG. 3.

With additional reference to FIG. 6, the stem 230 extends downward from the body portion 210, and is sized and shaped to be received in the channel 134 defined by the connecting portion 130. In the illustrated form, the stem 230 includes a pair of grooves 235 that correspond to the grooves 115, 125, and which receive the rails 131, 132 of the channel member 130 to provide lateral stability for the hinge cap 200. The illustrated stem 230 also includes an aperture 236 sized and shaped to receive a fastener (e.g., a set screw) by which the hinge cap 200 may be secured to the channel member 130. While an exemplary form of the stem 230 is illustrated, it should be appreciated that the geometry of the stem 230 may be dictated by the geometry of the channel 134 in which the stem 230 seats. Thus, the geometry of the stem 230 may be altered, for example in the event that should the geometry of the channel member 130 and/or the rails 115, 125 is/are different from those illustrated.

Figure 7:
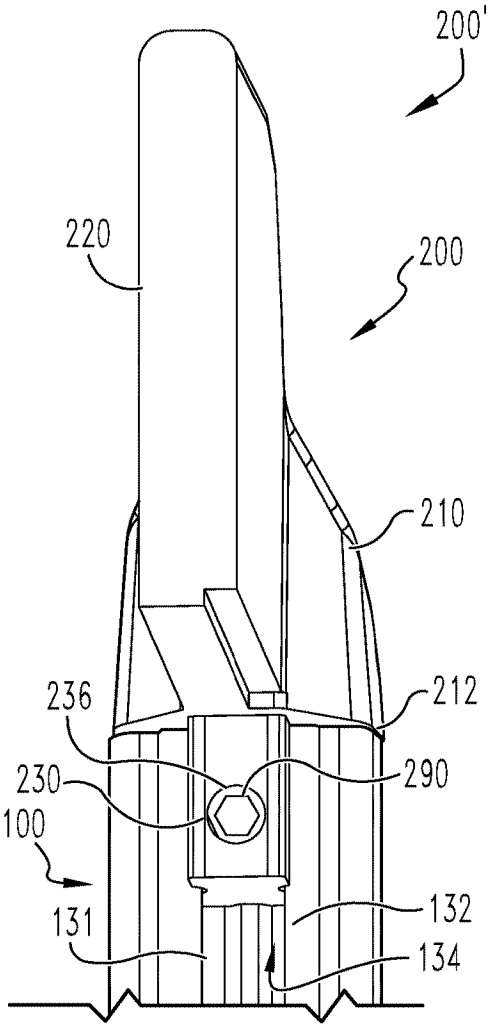
FIG. 7 is a perspective view of a portion of a hinge assembly according to certain embodiments.

With additional reference to FIG. 7, illustrated therein is a hinge assembly 200' according to certain embodiments. The hinge assembly 200' generally includes the hinge 100 and the hinge cap 200, which is mounted to the upper end 139 of the channel member. In the interest of clarity, the leaves 110, 120 are omitted from the illustration of FIG. 7. When assembled, the stem 230 is seated in the channel 134 such that the base 212 of the body portion 210 is substantially flush with the upper end 139 of the channel member 130. Additionally, a fastener such as a set screw 290 extends through the aperture 236 and engages the channel member 130 to retain engagement between the channel member 130 and the hinge cap 200. While the illustrated hinge assembly 200' includes the continuous hinge 100 illustrated in FIGS. 1 and 2, it is also contemplated that the hinge cap 200 may be utilized in connection with another form of hinge, such as a traditional form in which interleaved knuckles receive a hinge pin. For example, the hinge cap 200 may be provided with a stem that defines the hinge pin.

Figure 8:
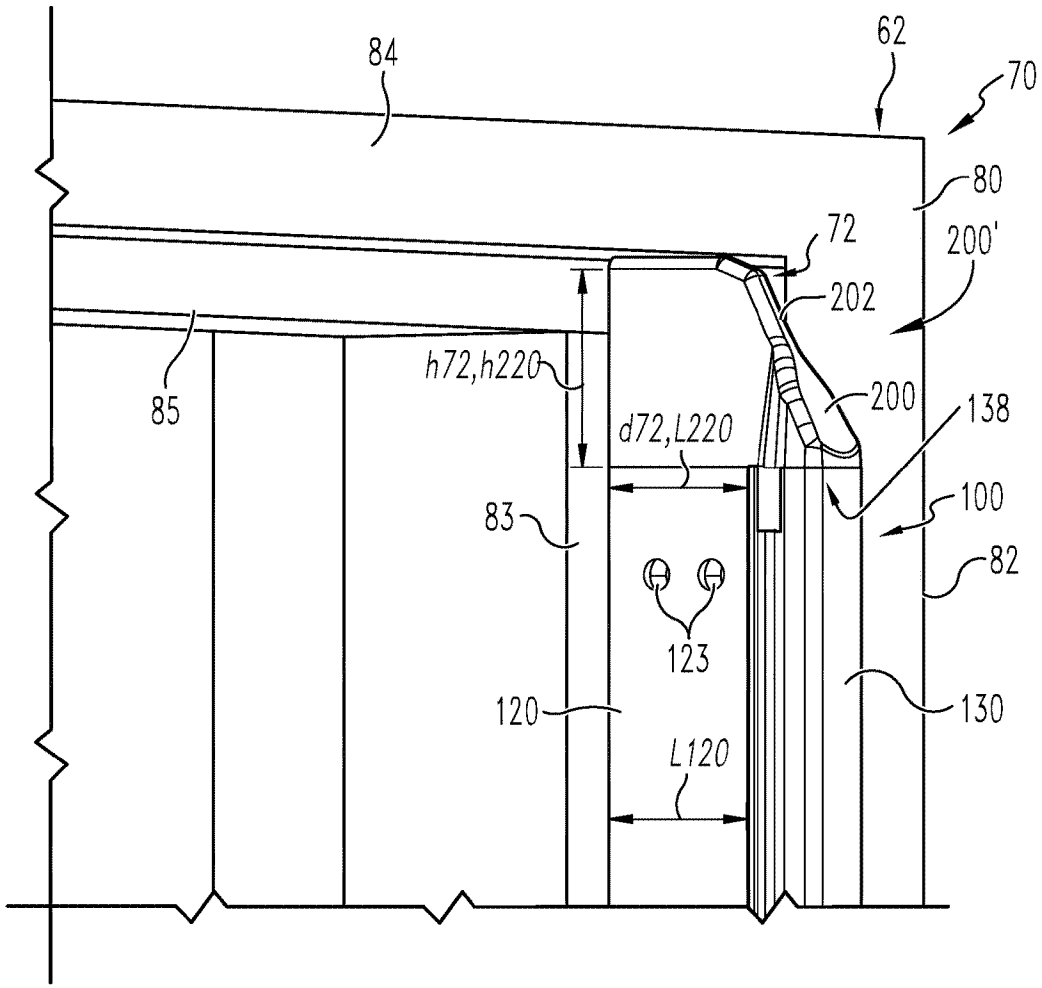
FIG. 8 is a perspective view of an anti-ligature closure assembly including the hinge assembly illustrated in FIG. 7.
Figure 10:
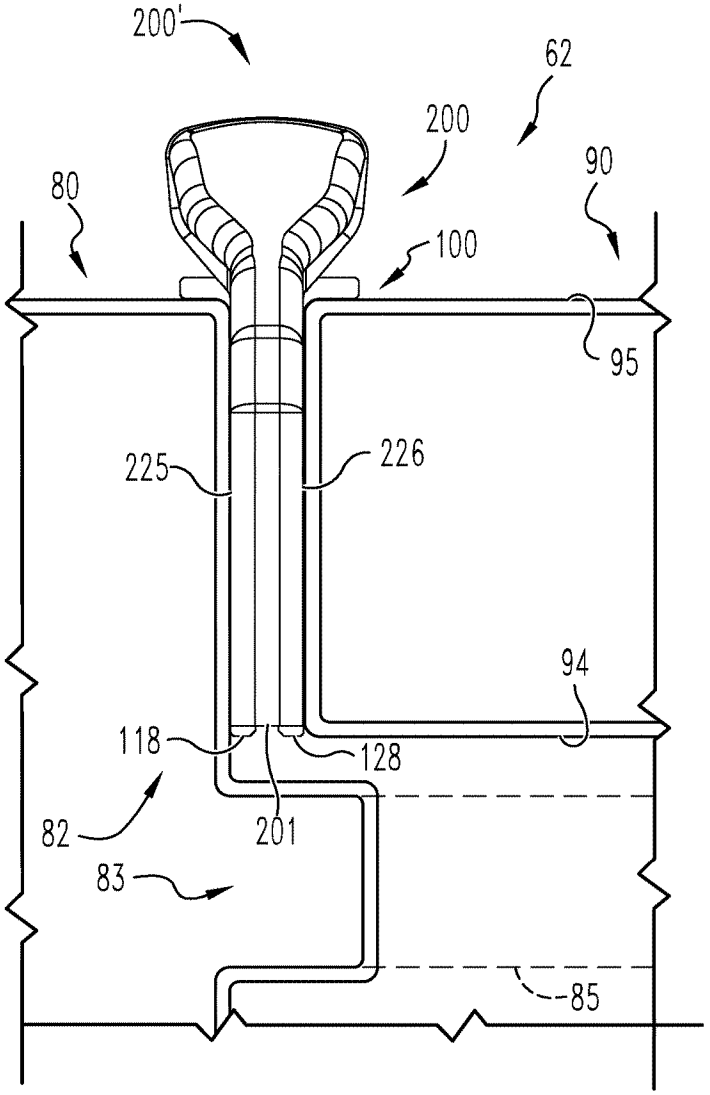
FIG. 10 is a top-down cutaway view of the closure assembly illustrated in FIG. 8.
Figure 9:
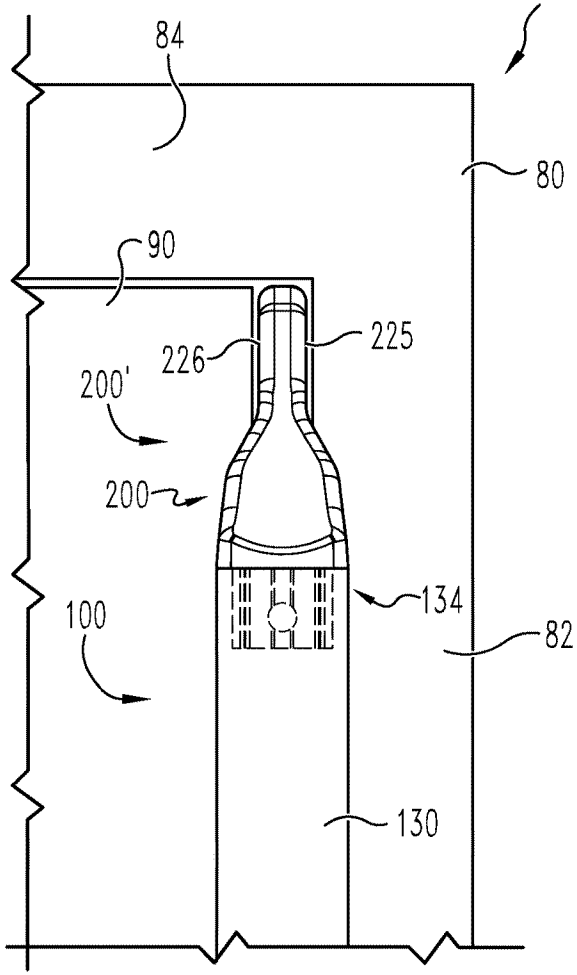
FIG. 9 is a front view of the closure assembly illustrated in FIG. 8.

With additional reference to FIGS. 8-10, illustrated therein is an anti-ligature closure assembly 62 according to certain embodiments, which includes the above-described closure assembly 70 and the hinge cap 200. Stated another way, the closure assembly 62 includes the doorframe 80, the door 90, and the above-described hinge assembly 200'. In the interests of clarity, the door 90 is not illustrated in FIG. 8.

With the anti-ligature closure assembly 62 assembled and the door 90 in its closed position, the gap 72 is substantially filled by the flange 220 of the hinge cap 200. More particularly, the flange 220 projects into the gap 72 such that the jamb-facing first face 225 faces the vertical interior surface of the hinge jamb 82 and the door-facing second face 226 faces the hinge edge 92. As noted above, the thickness t220 of the flange 220 may be selected to correspond to the width w72 of the gap 72. As a result, there is minimal clearance between the flange 220 and the frame 80 and minimal clearance between the flange 220 and the door 90 such that it is difficult or impossible to feed a ligature into the gap 72 while the door 90 is closed. Similarly, the height h220 of the flange 220 may be selected to correspond to the height h72 of the gap 72 such that there is minimal clearance between the upper side 223 of the flange 220 and the lower side of the head jamb 84, thereby discouraging or preventing a ligature from being fed between the upper side 223 and the head jamb 84 when the door 90 is closed.

With the door 90 in its closed position, the rear side 201 of the hinge cap 200 may be flush or substantially flush (e.g., within about a half-inch or within about a quarter-inch) with one or more other features of the closure assembly 70. In the illustrated form, the rear side 201 of the hinge cap 200 is flush with the rear sides 118, 128 of the leaves 110, 120, and is substantially flush with the first face 94 of the door 90. Alternatively, the rear side 201 of the hinge cap 200 may be substantially flush with the rear sides 118, 128 of the leaves 110, 120, and flush with the first face 94 of the door 90. In other embodiments, the rear side 201 of the hinge cap 200 may not necessarily be flush or substantially flush with the rear sides 118, 128 and/or the first face 94.

Figure 12:
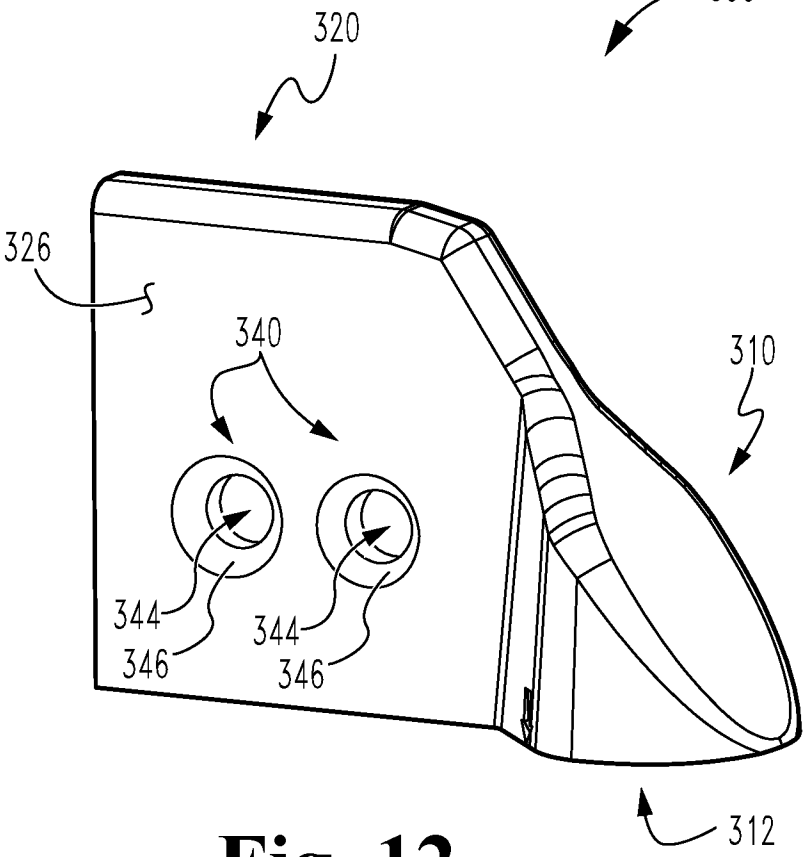
FIG. 12 is a second perspective view of the anti-ligature hinge cap illustrated in FIG. 11.
Figure 11:
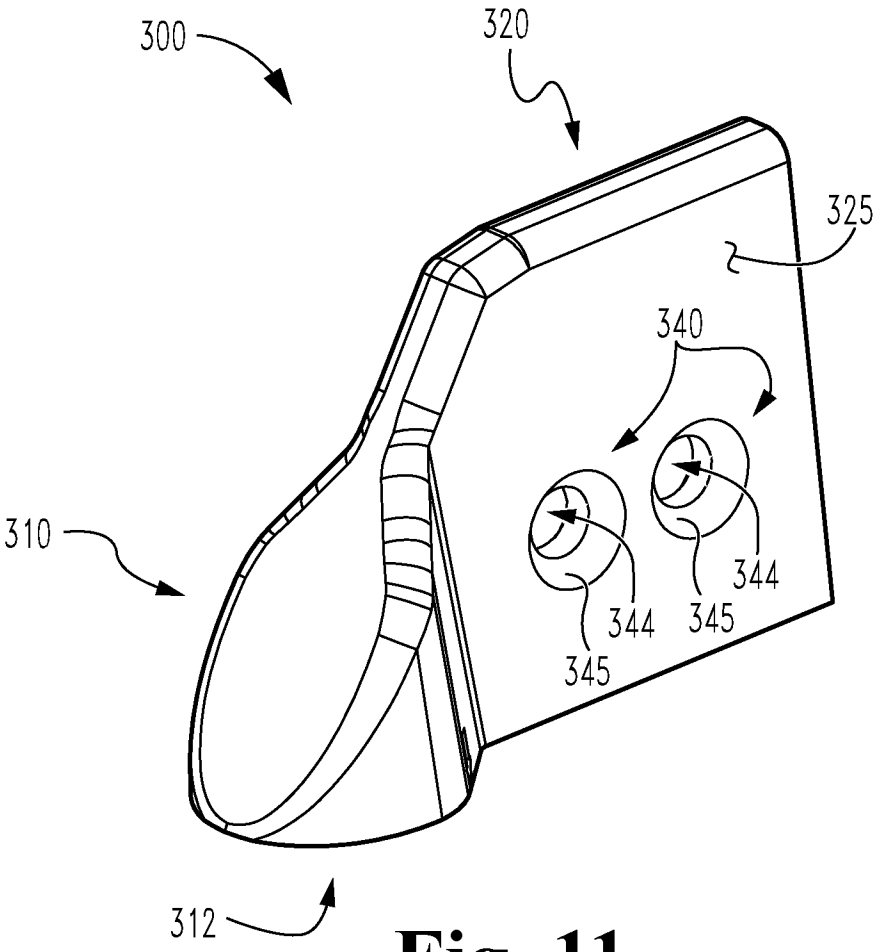
FIG. 11 is a first perspective view of an anti-ligature hinge cap according to certain embodiments.
Figure 20:
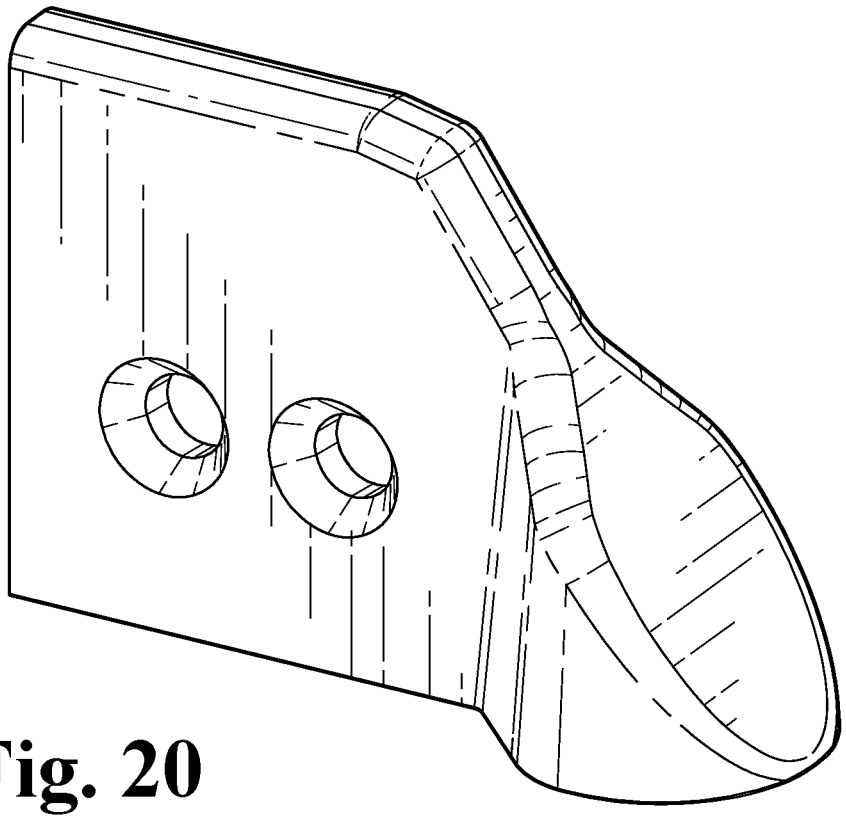
FIG. 20 is a first perspective view of an anti-ligature hinge cap according to certain embodiments.
Figure 21:
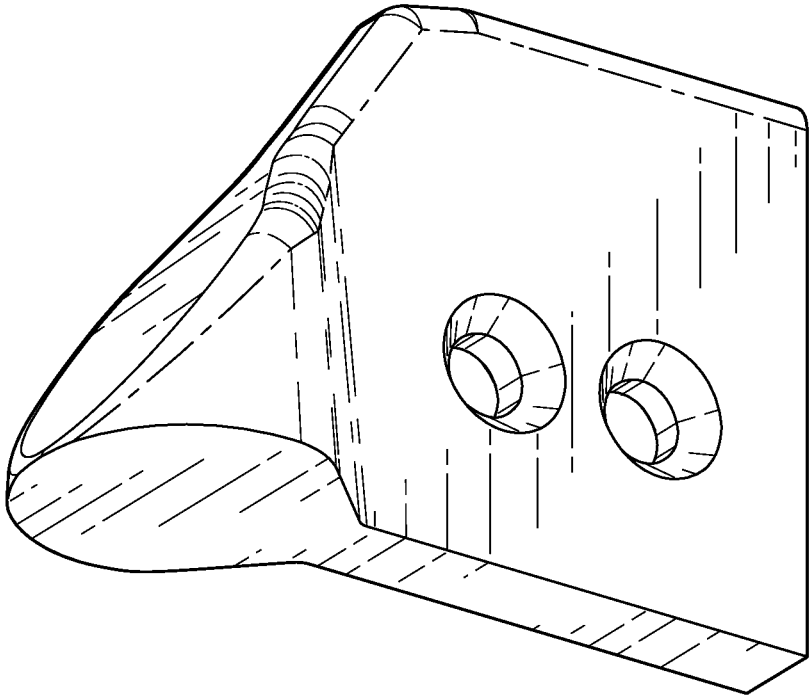
FIG. 21 is a second perspective view of the anti-ligature hinge cap illustrated in FIG. 20.

With additional reference to FIGS. 11 and 12, illustrated therein is a ligature-resistant hinge cap 300 according to certain embodiments. Further views of the ligature-resistant hinge cap 300 are provided in FIGS. 20 and 21. The hinge cap 300 is similar to the above-described hinge cap 200, and similar reference characters are used to indicate similar elements and features. For example, the hinge cap 300 generally includes a body portion 310 and a flange 320 extending rearwardly from the body portion 210, which generally correspond to the body portion 210 and the flange 220 of the hinge cap 200. In the interest of conciseness, the following description of the hinge cap 300 focuses primarily on elements and features that are different from those described above with reference to the hinge cap 200.

As noted above, the hinge cap 200 includes a stem 230 configured for coupling with the upper end 138 of the connecting portion 130 of the hinge 100 such that the hinge cap 200 pivots with the connecting portion 130. By contrast, such a stem may be omitted from the illustrated hinge cap 300, which is instead configured to be secured to one of the door 90 or the doorframe 80. More particularly, the flange 320 is configured to be secured to one of the hinge edge 92 or the hinge jamb 82 as described herein.

The flange 320 may include features that facilitate the installation of the hinge cap 300 to a closure assembly such as the closure assembly 70. For example, the flange 320 may include one or more openings 340 that facilitate the coupling of the flange 320 to one of the hinge edge 92 or the hinge jamb 82 by one or more fasteners, and in the illustrated form includes a pair of such openings 340. In the illustrated form, each opening 340 extends through the entire thickness of the flange 320. In other forms, the flange 320 may include a thin wall that at least partially encloses the opening(s) 340 such that the installation personnel break the wall with the fastener or another tool during installation of the hinge cap 300.

In certain forms, one or both sides of the opening(s) 340 may include a countersink 342 that receives a head of a threaded fastener 390 (FIG. 13) by which the flange 320 may be secured to the one of the hinge edge 92 or the hinge jamb 82. For example, each of the illustrated openings 340 includes a first countersink 345 formed in a first broad face 325 of the flange 320, and a second countersink 346 formed in an opposite second broad face 326 of the flange 320. In the illustrated form, the countersinks 345, 346 are connected by an aperture 344. It is also contemplated that a thin wall may be provided in the place of the aperture 344.

Figure 13:
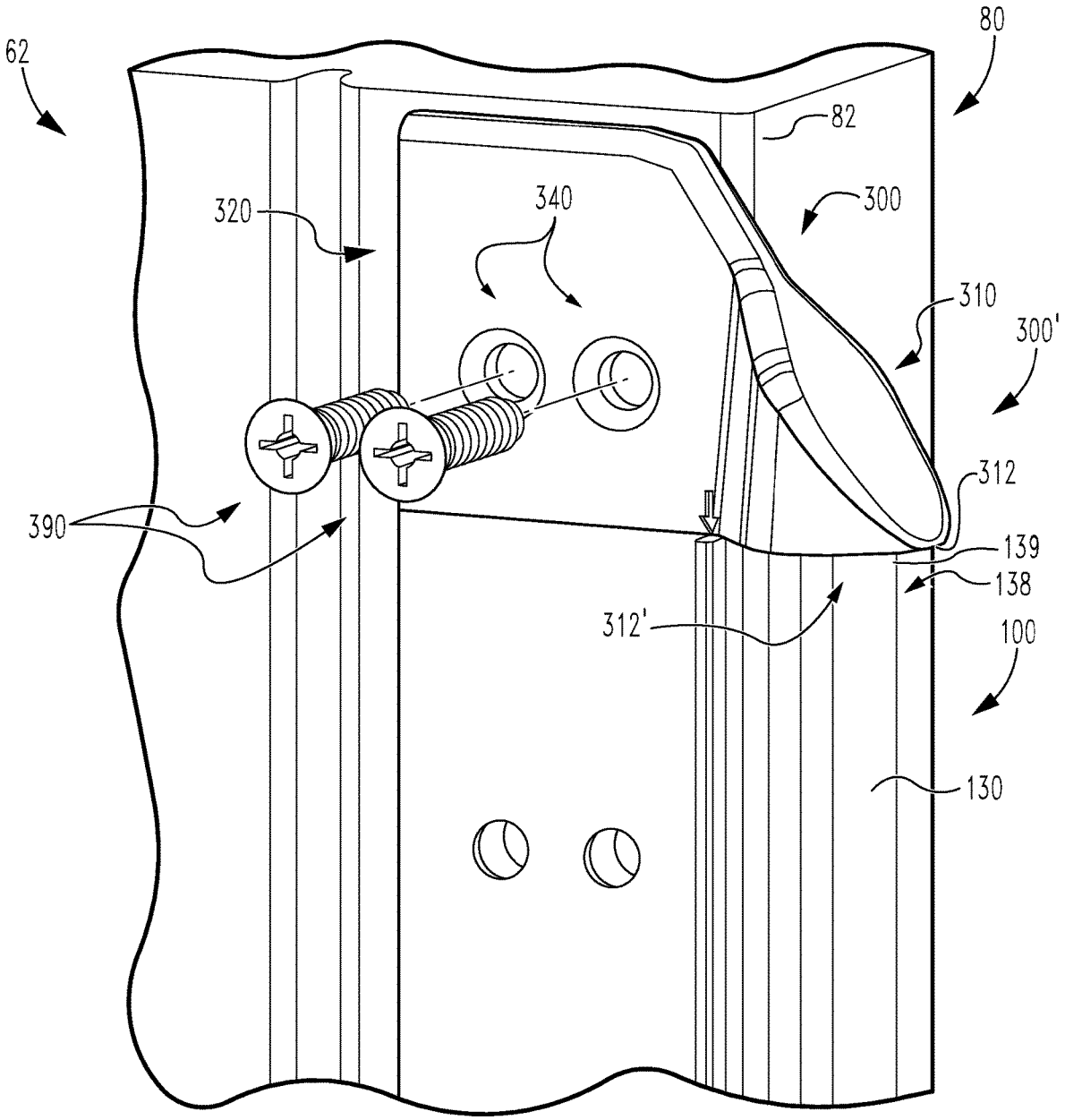
FIG. 13 is a perspective view of an anti-ligature closure assembly including the anti-ligature hinge cap illustrated in FIG. 11.

With additional reference to FIG. 13, illustrated therein is an anti-ligature closure assembly 62 according to certain embodiments, which includes the above-described closure assembly 70 and the hinge cap 300. Stated another way, the closure assembly 62 includes the doorframe 80, the door 90, and a hinge assembly 300' including the hinge 100 and the hinge cap 300. In the interests of clarity, the door 90 is omitted from the illustration of FIG. 13.

In the illustrated closure assembly 62, the flange 320 is secured to the doorframe 80, and more particularly to the hinge jamb 82. In other embodiments, the flange 320 may instead be secured to the hinge edge 92 of the door 90. Moreover, while the illustrated hinge cap 300 is secured to the hinge jamb 82 by threaded fasteners 390, it is also contemplated that the hinge cap 300 may be secured to the hinge jamb 82 and/or the hinge edge 92 in another manner, such as via unthreaded fasteners and/or adhesives.

In contrast to the hinge cap 200, which is mounted to the connecting portion 130 and rotates with the connecting portion 130 during opening and closing of the door 90, the illustrated hinge cap 300 is secured to one of the doorframe 80 or the door 90, and remains static relative to the corresponding one of the leaves 110, 120. As such, the connecting portion 130 moves relative to the body portion 310 during opening and closing of the door 90. In order to ensure that the upper face 139 of the connecting portion 130 remains covered at all door positions (to thereby discourage the hanging of ligatures regardless of door position), the base 312 may be sized and shaped such that the base 312 covers the upper face 139 throughout the opening and closing movement of the hinge 100. In other words, the base 312 may be oversized relative to the upper face 139 such that an overhang 312' is provided during at least a portion of the opening/closing movement of the hinge 100.

As noted above, each of the illustrated openings 340 is countersunk on each side thereof. For a particular installation, the first countersink 345 may facilitate installation of the hinge cap 300 to the doorframe 80, while the second countersink 346 may facilitate installation of the hinge cap 300 to the door 90. The pair of countersinks 345, 346 may also facilitate installation of the hinge cap 300 to doors of different handedness. For example, in a closure assembly in which the door 90 is mounted in an opposite handedness as that illustrated, the first countersink 345 may facilitate installation of the hinge cap 300 to the door 90, while the second countersink 346 may facilitate installation of the hinge cap 300 to the doorframe 80. In certain forms, the fasteners 390 by which the hinge cap 300 is secured to the one of the doorframe 80 or the door 90 may be of the same form as those used to mount the hinge 100 to the doorframe 80 and the door 90.

Figure 15:
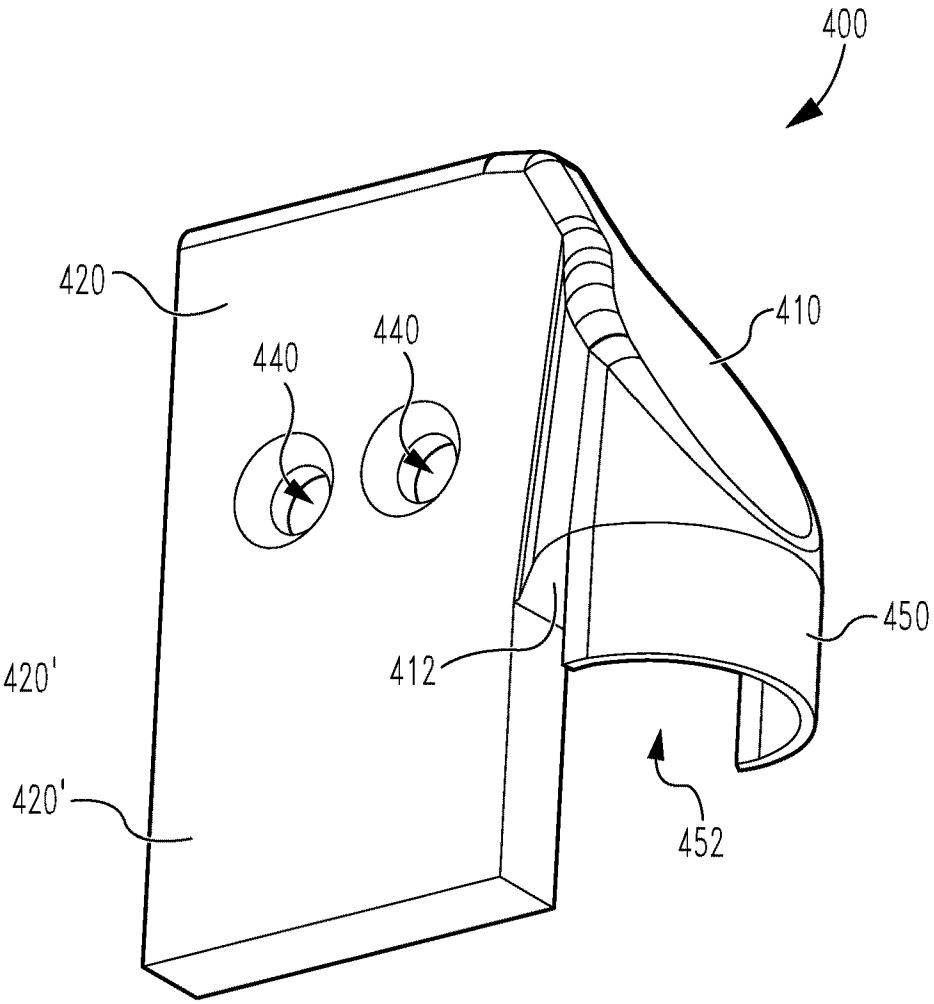
FIG. 15 is a second perspective view of the anti-ligature hinge cap illustrated in FIG. 14.
Figure 14:
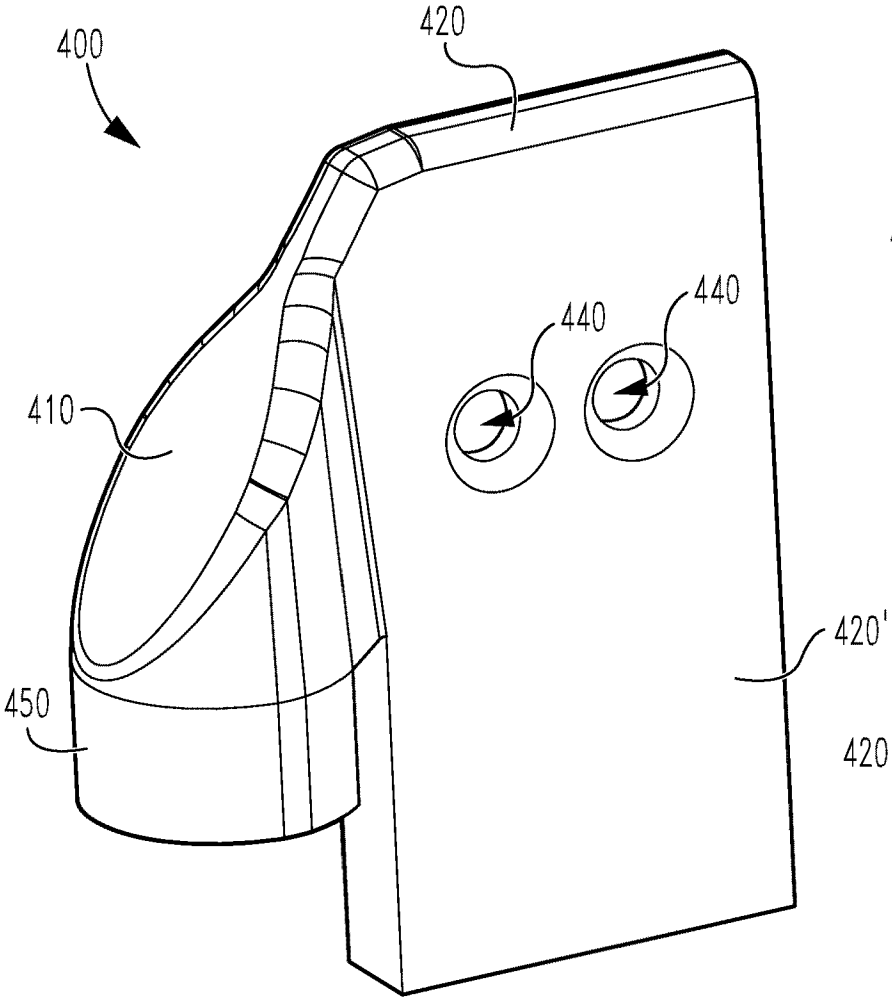
FIG. 14 is a first perspective view of an anti-ligature hinge cap according to certain embodiments.
Figure 22:
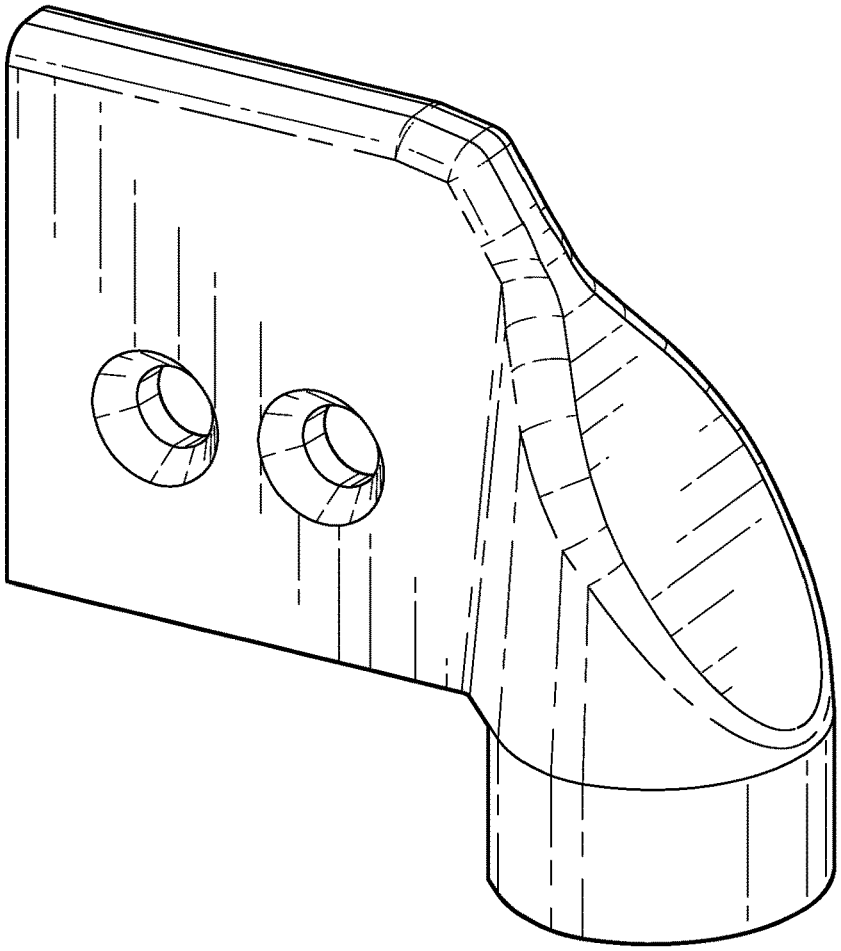
FIG. 22 is a first perspective view of an anti-ligature hinge cap according to certain embodiments.
Figure 23:
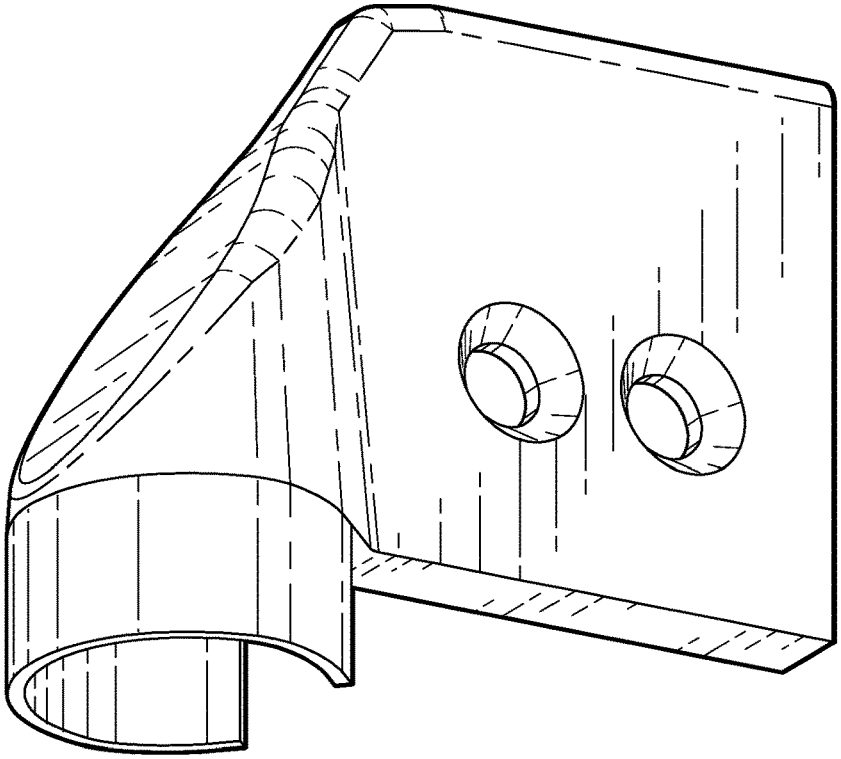
FIG. 23 is a second perspective view of the anti-ligature hinge cap illustrated in FIG. 22.
Figure 24:
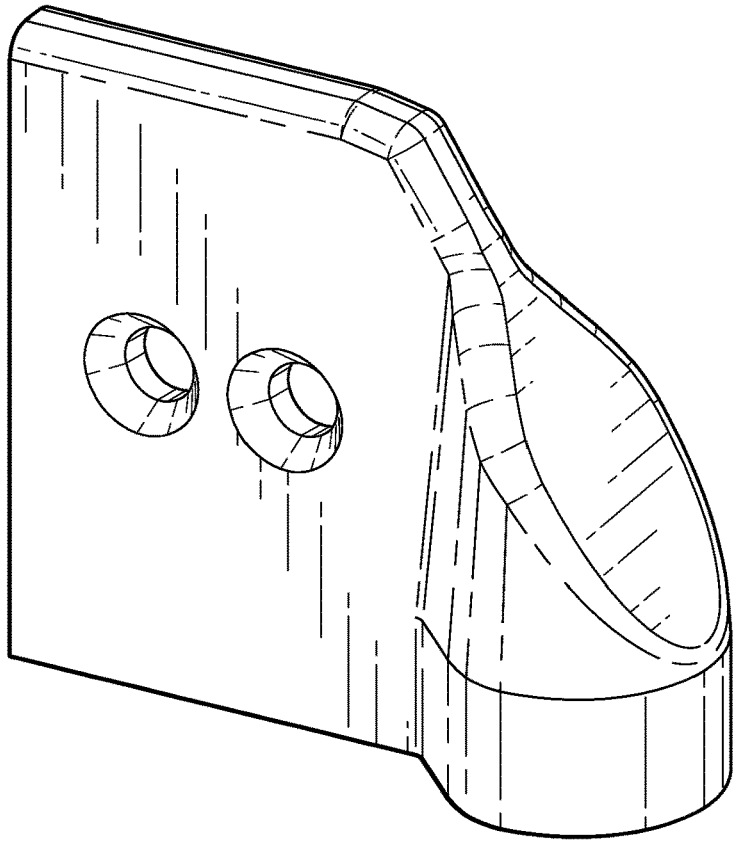
FIG. 24 is a first perspective view of an anti-ligature hinge cap according to certain embodiments.
Figure 25:
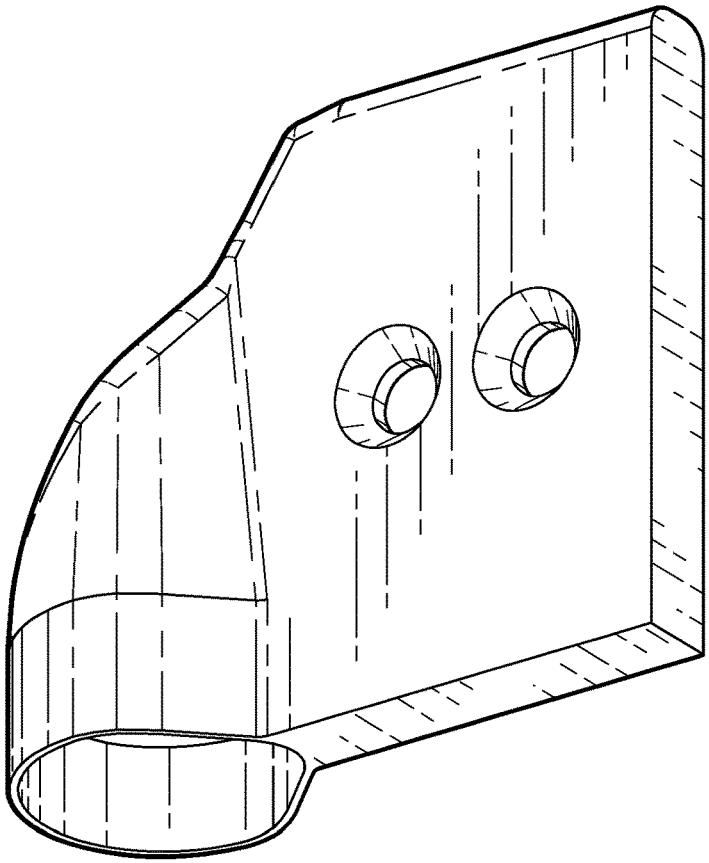
FIG. 25 is a second perspective view of the anti-ligature hinge cap illustrated in FIG. 24.
Figure 27:
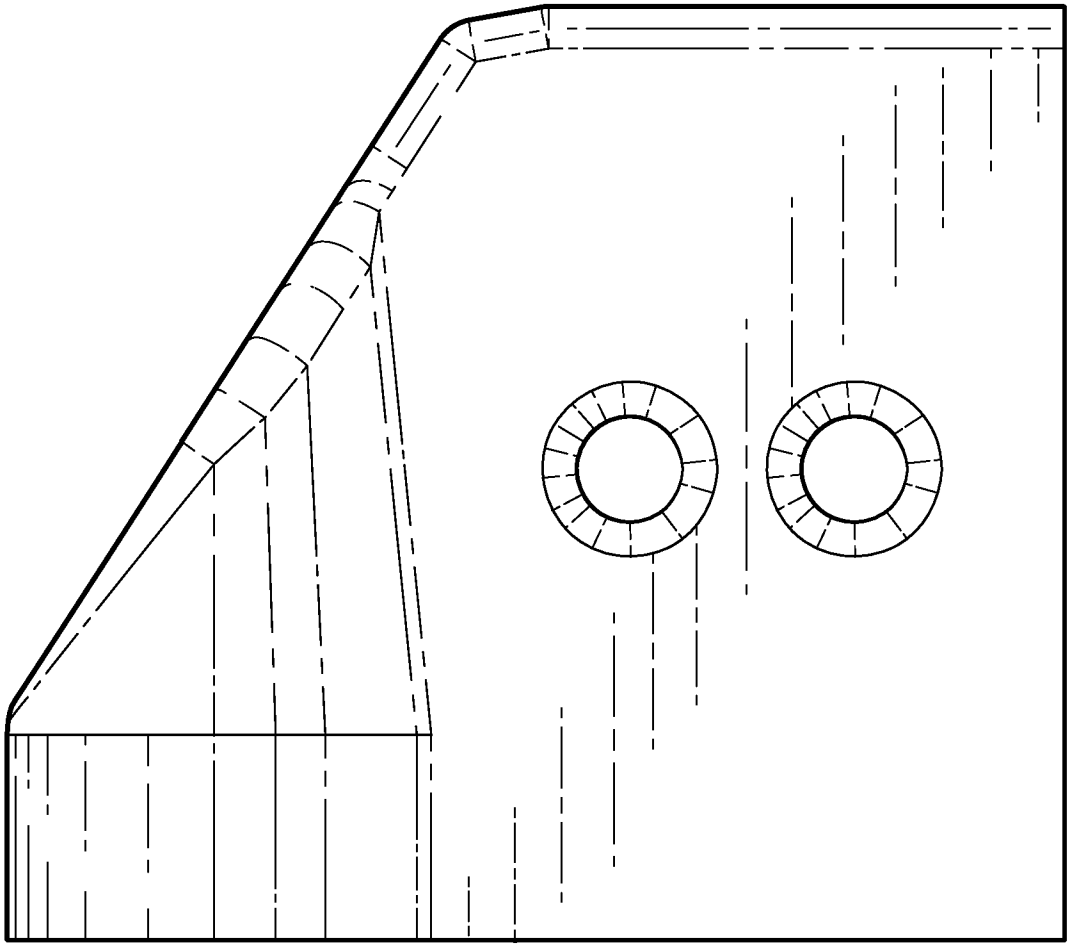
FIG. 27 is a right-side view of the anti-ligature hinge cap illustrated in FIG. 24.
Figure 26:
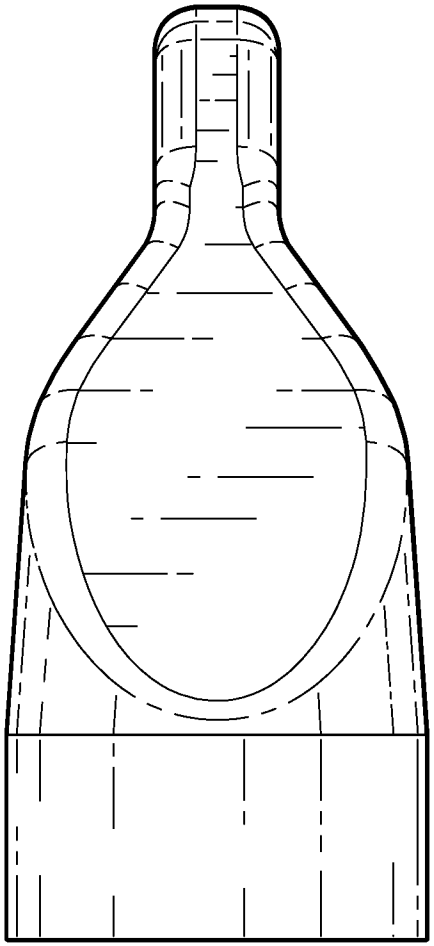
FIG. 26 is a front-side view of the anti-ligature hinge cap illustrated in FIG. 24.
Figure 28:
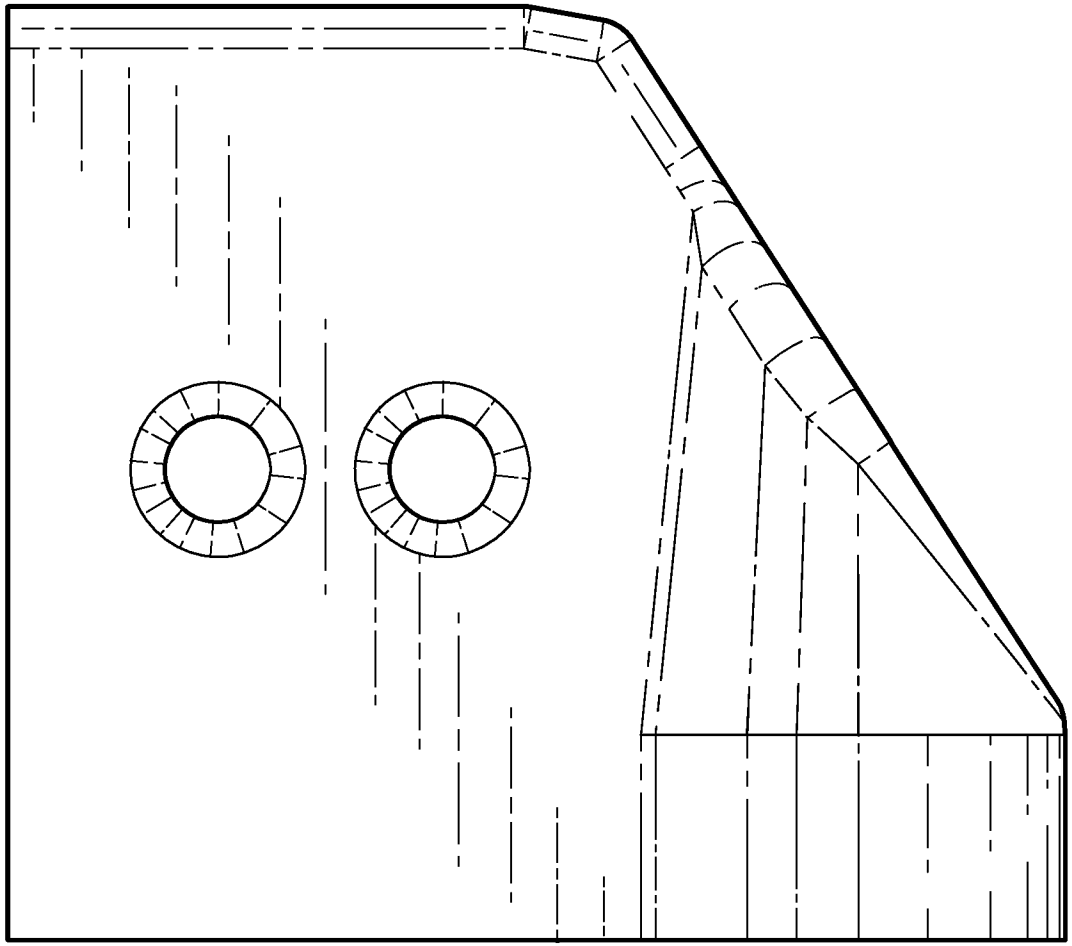
FIG. 28 is a right-side view of the anti-ligature hinge cap illustrated in FIG. 24.
Figure 29:
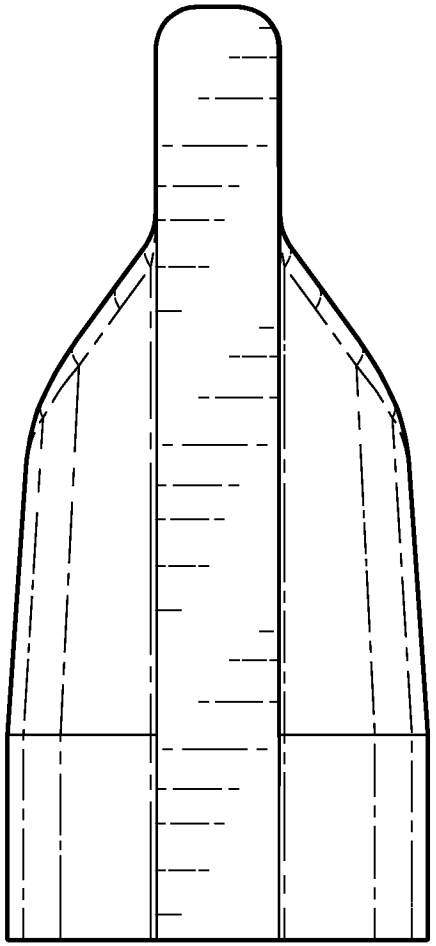
FIG. 29 is a rear-side view of the anti-ligature hinge cap illustrated in FIG. 24.
Figure 31:
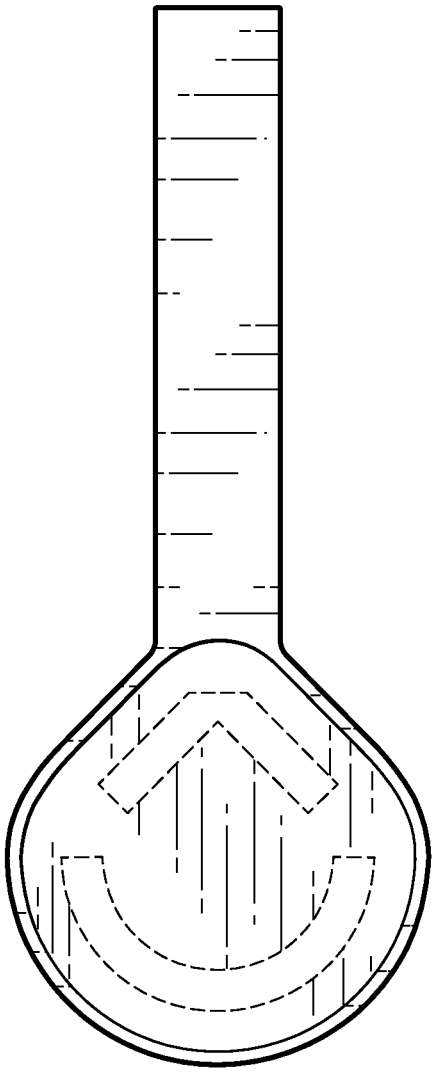
FIG. 31 is a bottom-up view of the anti-ligature hinge cap illustrated in FIG. 24.
Figure 30:
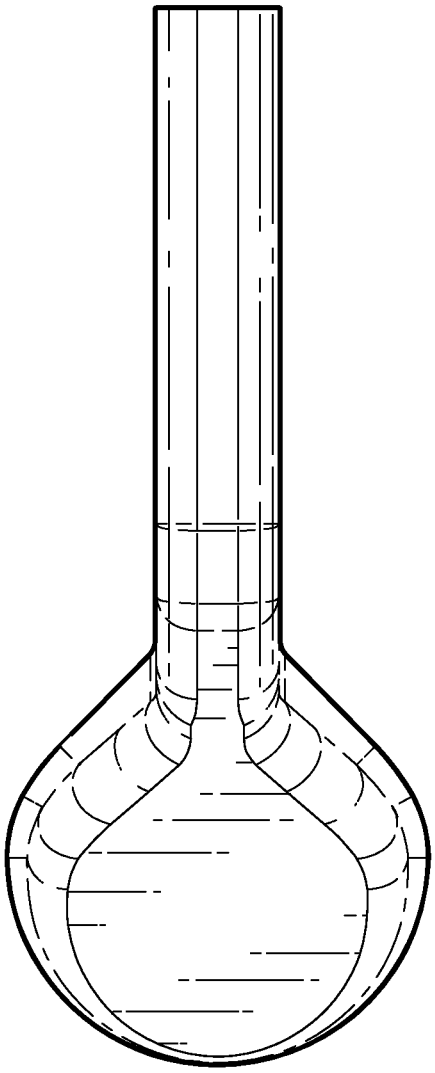
FIG. 30 is a top-down view of the anti-ligature hinge cap illustrated in FIG. 24.

With additional reference to FIGS. 14 and 15, illustrated therein is a ligature-resistant hinge cap 400 according to certain embodiments. Further views of the ligature-resistant hinge cap 400 are provided in FIGS. 22 and 23. The hinge cap 400 is similar to the above-described hinge cap 300, and similar reference characters are used to indicate similar elements and features. For example, the hinge cap 400 generally includes a body portion 410, a flange 420, and at least one opening 440, which respectively correspond to the body portion 310, flange 320, and opening(s) 340 of the hinge cap 300. In the interest of conciseness, the following description of the hinge cap 400 focuses primarily on elements and features that are different from those described above with reference to the hinge cap 300.

In the illustrated form, the hinge cap 400 further includes a shield 450 that depends from the base 412 of the body portion 410. The illustrated shield 450 is generally curved, and defines a cavity 452 sized and shaped to at least partially receive the upper end portion 138 of the connecting portion 130. As described herein, the shield 450 provides further protection to ensure that the upper face 139 remains covered throughout the opening and closing movement of the door 90.

In certain forms, the flange 420 may include an extension 420' that extends below the base 412 of the body portion 410. The extension 420' may be sized to extend to the upper faces of the leaves 110, 120 when the base 412 is seated on the upper face 139 of the connecting portion 130. It is also contemplated that the extension 420' may be omitted. Moreover, while the extension 420' is illustrated in connection with the hinge cap 400, it should be appreciated that other forms of hinge cap described herein, including the hinge caps 200, 300, 500, may include such an extension.

Figure 16:
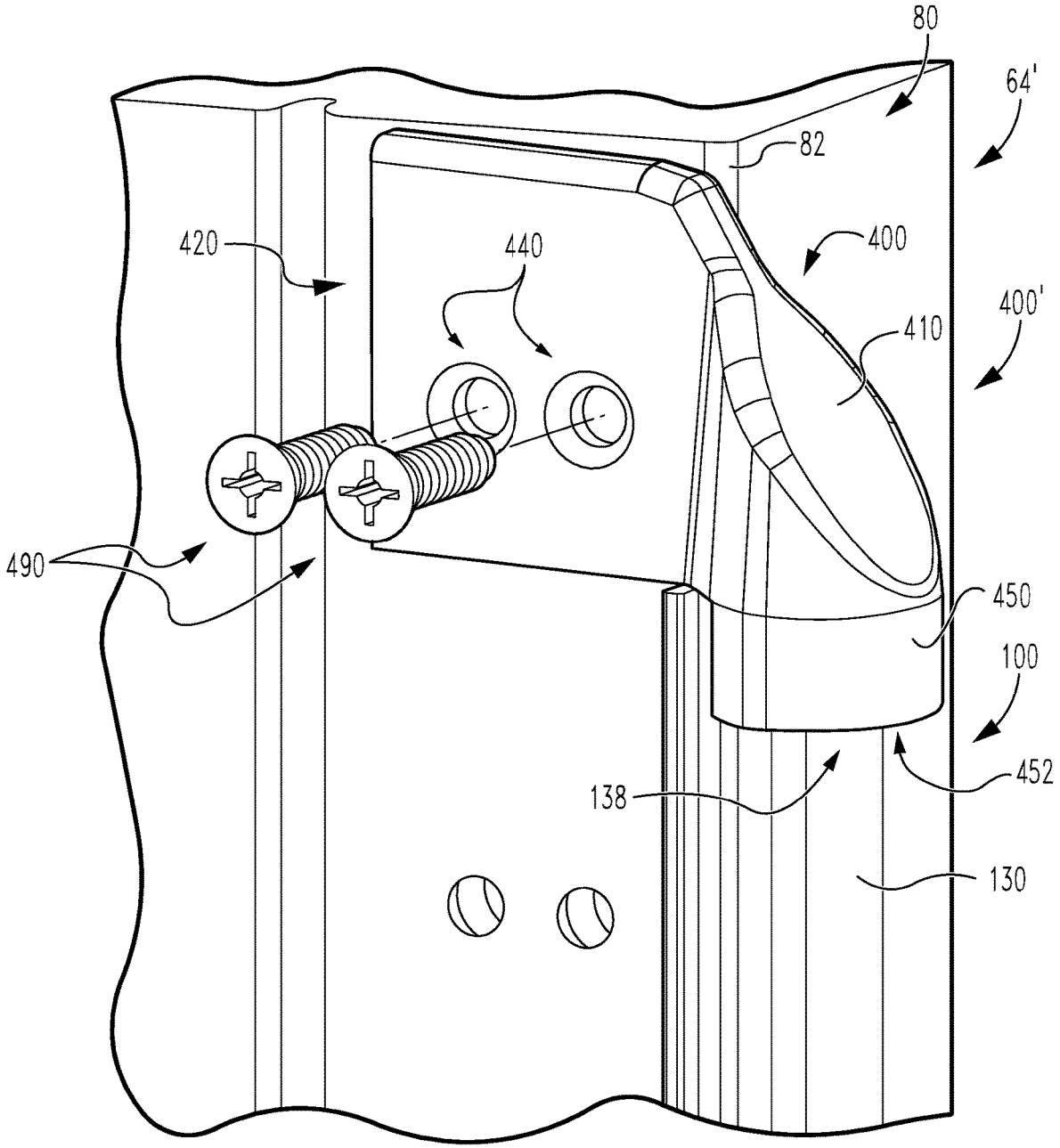
FIG. 16 is a perspective view of an anti-ligature closure assembly including the anti-ligature hinge cap illustrated in FIG. 14.

With additional reference to FIG. 16, illustrated therein is an anti-ligature closure assembly 64' according to certain embodiments, which includes the above-described closure assembly 70 and the hinge cap 400. Stated another way, the closure assembly 64' includes the doorframe 80, the door 90, and a hinge assembly 400' including the hinge 100 and the hinge cap 400. In the interests of clarity, the door 90 is omitted from the illustration of FIG. 16. The closure assembly 64' is substantially similar to the above-described closure assembly 62. In the interest of conciseness, the following description of the closure assembly 64' focuses primarily on elements and features not specifically described above with reference to the closure assembly 62.

The shield 450 extends beyond the base 412 of the body portion 410, and at least partially covers the upper end portion 138 of the connecting portion 130 such that the upper end portion 138 is at least partially received in the cavity 452. This may aid in covering any gaps that may be created by failing to install the base 412 flush with the upper face 139. The shield 450 may additionally or alternatively aid in maintaining the upper face 139 covered by the base 412 during the opening and closing movement of the door 90.

Figure 18:
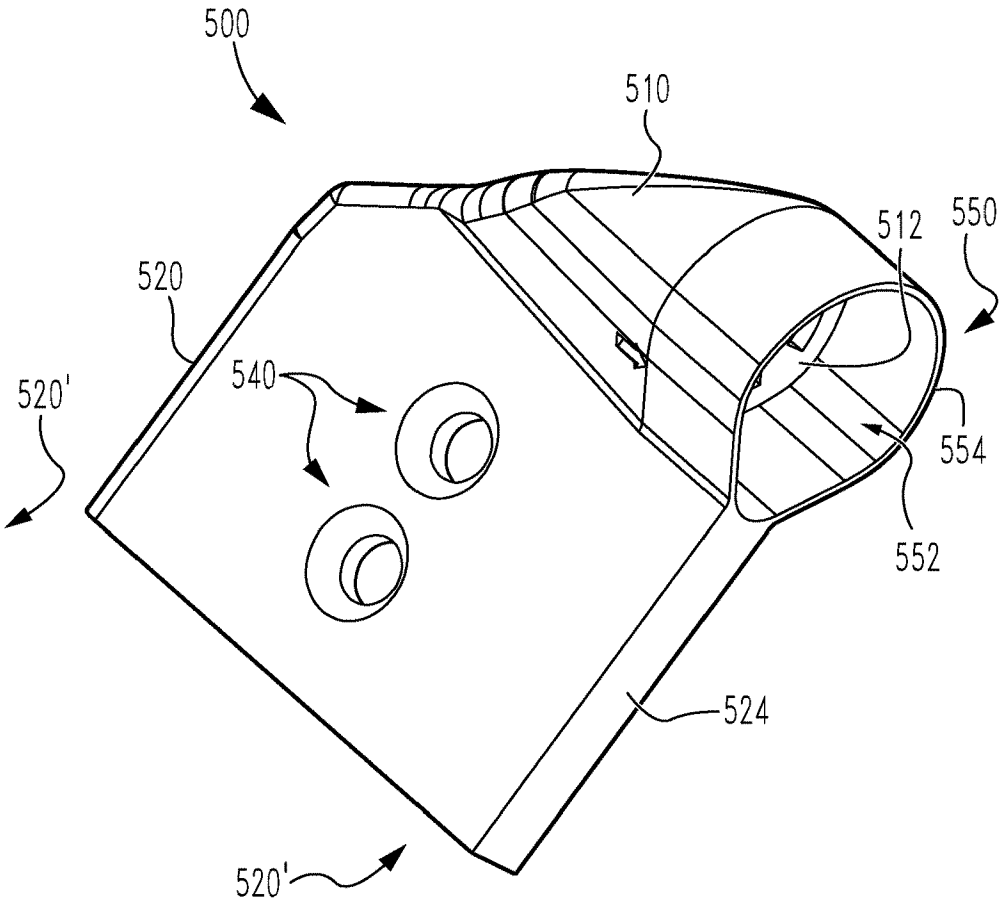
FIG. 18 is a second perspective view of the anti-ligature hinge cap illustrated in FIG. 17.
Figure 17:
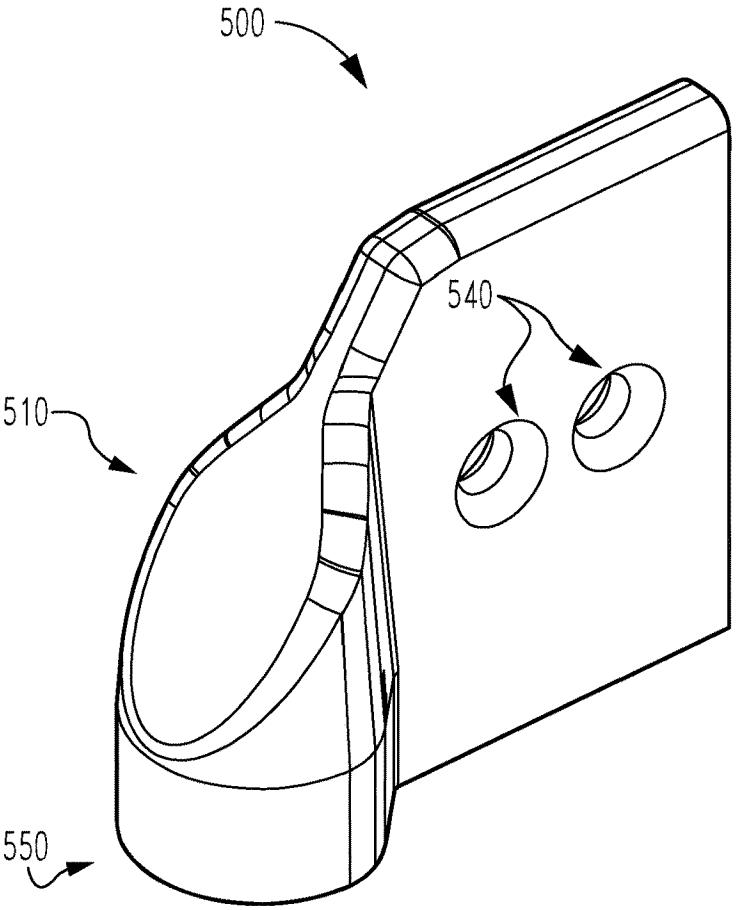
FIG. 17 is a first perspective view of an anti-ligature hinge cap according to certain embodiments.

With additional reference to FIGS. 17 and 18, illustrated therein is a ligature-resistant hinge cap 500 according to certain embodiments. Further views of the ligature-resistant hinge cap 500 are provided in FIGS. 22-30. The hinge cap 500 is similar to the above-described hinge cap 400, and similar reference characters are used to indicate similar elements and features. For example, the hinge cap 500 generally includes a body portion 510, a flange 520, at least one opening 540, and a shield 550, which respectively correspond to the body portion 410, flange 420, opening(s) 440, and shield 450 of the hinge cap 400. In the interest of conciseness, the following description of the hinge cap 500 focuses primarily on elements and features that are different from those described above with reference to the hinge cap 400.

As with the above-described shield 450, the shield 550 depends from the base 512 of the body portion 510. In the illustrated form, however, the shield 550 is circumferentially enclosed, and a bottom surface 554 of the shield 550 is flush with the bottom surface 524 of the flange 520. The illustrated hinge cap 500 may thus be considered to include an extension 520' that extends below the base 512 and defines the bottom surface 524 of the flange 520.

Figure 19:
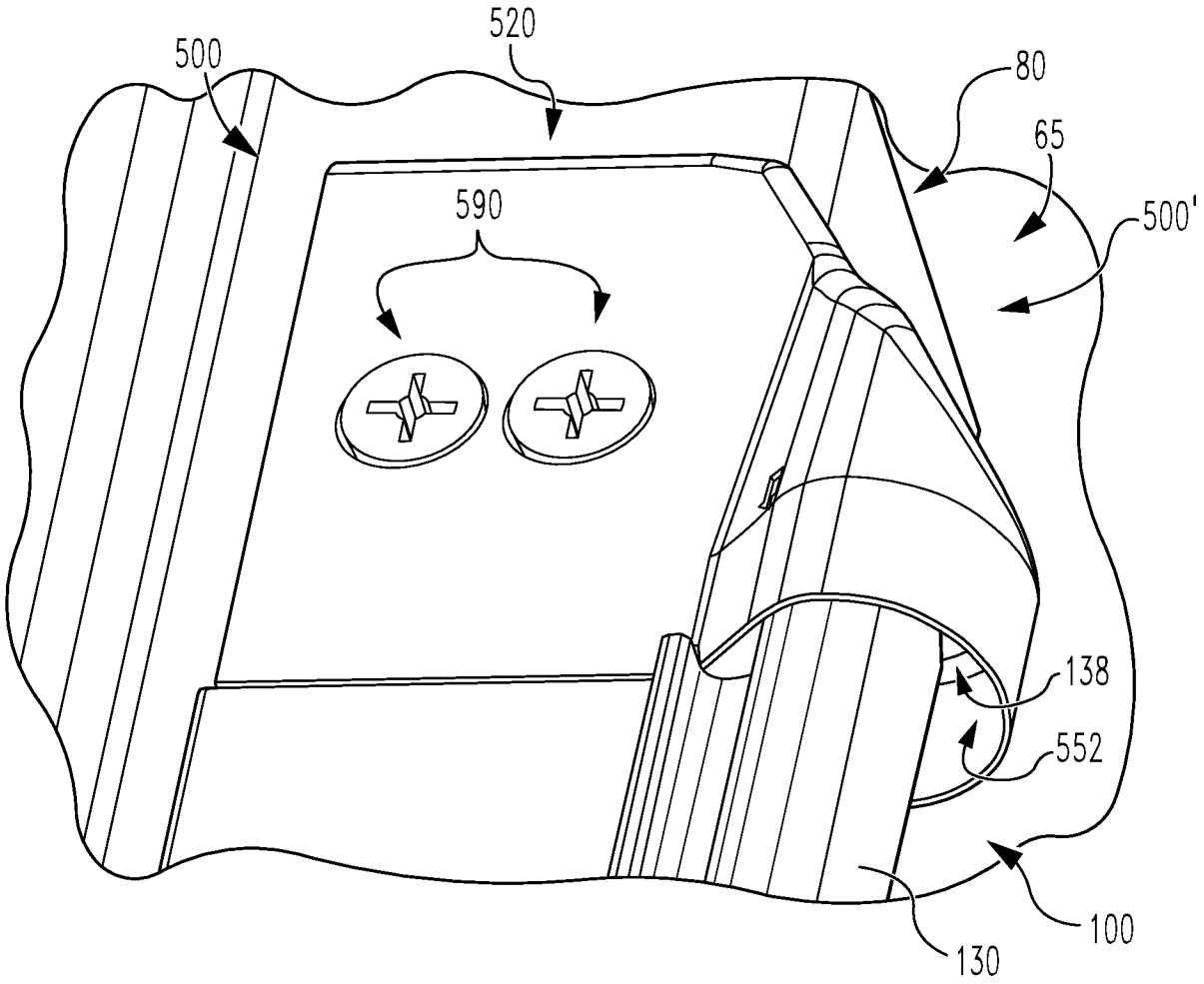
FIG. 19 is a perspective view of an anti-ligature closure assembly including the anti-ligature hinge cap illustrated in FIG. 17.

With additional reference to FIG. 19, illustrated therein is an anti-ligature closure assembly 65 according to certain embodiments, which includes the above-described closure assembly 70 and the hinge cap 500. Stated another way, the closure assembly 65 includes the doorframe 80, the door 90, and a hinge assembly 500' including the hinge 100 and the hinge cap 500. In the interests of clarity, the door 90 is omitted from the illustration of FIG. 19. The closure assembly 65 is substantially similar to the above-described closure assembly 64'. In the interest of conciseness, the following description of the closure assembly 65 focuses primarily on elements and features not specifically described above with reference to the closure assembly 64'.

In the illustrated form, the upper end portion 138 of the connecting portion 130 extends above the upper edges of the leaves 110, 120, which are adjacent the lower surface 524 of the flange 520. Additionally, the upper end portion 138 extends into the cavity 552 of the shield 550, which may aid in covering any gaps that may be created by failing to install the base 512 flush with the upper face 139.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method of discouraging hanging of ligatures from a closure assembly comprising a frame, a hinge mounted to the frame, and a door mounted to the hinge such that a gap is defined between a hinge side of the door and a hinge jamb of the frame, the method comprising:

positioning a ligature-resistant hinge cap in an installation position relative to the closure assembly, comprising positioning a flange of the ligature-resistant hinge cap within the gap; and with the ligature-resistant hinge cap in the installation position, securing the ligature-resistant hinge cap to one of the frame or the door.

2. The method of claim 1, wherein the flange defines a rear side of the ligature-resistant hinge cap;

wherein the ligature-resistant hinge cap further comprises a front side opposite the rear side; and wherein the front side is sloped.

3. The method of claim 2, wherein the frame further comprises a head jamb including a head stop;

wherein the door further comprises a first face and a second face;

wherein an upper portion of the first face faces the head stop; and wherein the rear side of the flange is positioned adjacent the first face.

4. The method of claim 1, wherein the frame further comprises a head jamb; and wherein a top of the flange is adjacent the head jamb when the ligature-resistant hinge cap is attached to the top of the hinge.

5. The method of claim 1, wherein securing the ligature-resistant hinge cap to one of the frame or the door comprises securing the ligature-resistant hinge cap to one of the frame or the door via a threaded fastener.

6. The method of claim 5, wherein securing the ligature-resistant hinge cap to one of the frame or the door via a threaded fastener comprises passing a portion of the threaded fastener through a preformed opening in the flange.

7. The method of claim 1, wherein securing the ligature-resistant hinge cap to one of the frame or the door comprises securing the ligature-resistant hinge cap to the frame.

8. The method of claim 1, wherein positioning the ligature-resistant hinge cap in the installation position further comprises covering an upper face of a connecting portion of the hinge with a base of a body portion of the ligature-resistant hinge cap.

9. The method of claim 1, wherein positioning the ligature-resistant hinge cap in the installation position further comprises covering an upper end portion of a connecting portion of the hinge with a shield of the ligature-resistant hinge cap.

10. A hinge assembly having an open state and a closed state, the hinge assembly comprising:

a first leaf configured for coupling to a hinge jamb of a doorframe;

a second leaf configured for coupling to a hinge edge of a door, wherein the first leaf and the second leaf face one another when the hinge assembly is in the closed state;

a connecting portion pivotably coupling the first leaf and the second leaf; and a ligature-resistant hinge cap, comprising:

a body portion including a base covering an upper face of the connecting portion; and a flange extending from the body portion, wherein the flange is sized and shaped for insertion in a gap between the hinge jamb of the doorframe and the hinge edge of the door when the hinge assembly is in the closed state, and wherein the flange is aligned with one of the first leaf or the second leaf.

11. The hinge assembly of claim 10, wherein the flange includes an opening operable to receive a portion of a fastener for securing the ligature-resistant hinge cap to one of the door or the doorframe.

12. The hinge assembly of claim 11, wherein the opening extends through an entire thickness of the flange.

13. The hinge assembly of claim 11, wherein the opening comprises a first counter-sunk opening.

14. The hinge assembly of claim 13, wherein the opening further comprises a second counter-sunk opening opposite the first counter-sunk opening.

15. The hinge assembly of claim 10, wherein the first leaf and the second leaf together define a first thickness dimension when the hinge assembly is in the closed state; and wherein the flange has a second thickness dimension corresponding to the first thickness dimension.

16. The hinge assembly of claim 10, wherein the base covers the upper face of the connecting portion throughout a movement of the hinge assembly between the open state and the closed state while the flange remains aligned with one of the first leaf or the second leaf.

17. The hinge assembly of claim 10, wherein the ligature-resistant hinge cap further comprises a shield that extends from the body portion beyond the upper face of the connecting portion.

18. The hinge assembly of claim 10, wherein the flange is planar and is arranged in parallel alignment with the one of the first leaf or the second leaf.

19. The hinge assembly of claim 10, wherein the flange includes a first surface configured to face the hinge jamb of the doorframe and a second surface facing opposite the first surface and configured to face the hinge edge of the door when the hinge assembly is in the closed state.

20. A hinge assembly having an open state and a closed state, the hinge assembly comprising:

a first leaf configured for coupling to a hinge jamb of a doorframe;

a second leaf configured for coupling to a hinge edge of a door, wherein the first leaf and the second leaf face one another when the hinge assembly is in the closed state;

a connecting portion pivotably coupling the first leaf and the second leaf and a ligature-resistant hinge cap, comprising:

a body portion including a base covering an upper face of the connecting portion; and a flange extending from the body portion and aligned with one of the first leaf or the second leaf; and wherein the first leaf and the second leaf together define a first thickness dimension when the hinge assembly is in the closed state, wherein the flange has a second thickness dimension corresponding to the first thickness dimension, and wherein the second thickness dimension is no greater than the first thickness dimension.

21. A hinge assembly having an open state and a closed state, the hinge assembly comprising:

a first leaf configured for coupling to a hinge jamb of a doorframe;

a second leaf configured for coupling to a hinge edge of a door, wherein the first leaf and the second leaf face one another when the hinge assembly is in the closed state;

a connecting portion pivotably coupling the first leaf and the second leaf; and a ligature-resistant hinge cap, comprising:

a body portion including a base covering an upper face of the connecting portion; and a flange extending from the body portion and aligned with one of the first leaf or the second leaf; and wherein the flange further comprises an extension that extends beyond the base toward an upper edge of one of the first leaf or the second leaf.

22. The hinge assembly of claim 21, wherein a lower edge of the flange abuts the upper edge of the one of the first leaf or the second leaf.

23. A closure assembly, comprising:

a hinge assembly having an open state and a closed state, the hinge assembly comprising:

a first leaf configured for coupling to a hinge jamb of a doorframe;

a second leaf configured for coupling to a hinge edge of a door, wherein the first leaf and the second leaf face one another when the hinge assembly is in the closed state;

a connecting portion pivotably coupling the first leaf and the second leaf; and a ligature-resistant hinge cap, comprising:

a body portion including a base covering an upper face of the connecting portion; and a flange extending from the body portion and aligned with one of the first leaf or the second leaf; and the doorframe, the doorframe comprising the hinge jamb, wherein the hinge jamb is coupled with the first leaf; and the door, the door comprising the hinge edge, wherein the hinge edge is coupled to the second leaf and faces the hinge jamb such that a gap is defined between the hinge edge and the hinge jamb;

wherein the flange extends into the gap; and wherein the flange is secured to one of the hinge jamb or the hinge edge.

24. The closure assembly of claim 23, further comprising a threaded fastener securing the flange to the one of the hinge jamb or the hinge edge.

25. A ligature-resistant hinge cap configured for use with a hinge including a pair of leaves and a connecting portion connecting the pair of leaves, the ligature-resistant hinge cap comprising:

a body portion having an upper side and comprising a base configured to cover an upper face of the connecting portion;

a flange extending rearward from the body portion;

a rear side defined by the flange; and a front side opposite the rear side, wherein the front side is sloped from the upper side of the body portion to the base.

26. The ligature-resistant hinge cap of claim 25, wherein the flange has a first thickness dimension;

wherein a portion of the body portion has a second thickness dimension greater than the first thickness dimension; and wherein the ligature-resistant hinge cap tapers from the first thickness dimension to the second thickness dimension.

27. The ligature-resistant hinge cap of claim 25, wherein the flange comprises an opening operable to receive a portion of a fastener for securing the flange to one of a door or a doorframe.

28. The ligature-resistant hinge cap of claim 27, wherein the opening comprises a first countersink formed on a first side of the opening.

29. The ligature-resistant hinge cap of claim 28, wherein the opening comprises a second countersink formed on a second side of the opening.

30. The ligature-resistant hinge cap of claim 25, further comprising a shield extending from the base and operable to cover an upper end portion of the connecting portion.

31. The ligature-resistant hinge cap of claim 25, further comprising a shield depending from the base.

32. The ligature-resistant hinge cap of claim 31, wherein the shield defines a cavity operable to receive an upper end portion of the connecting portion.

33. The ligature-resistant hinge cap of claim 25, wherein the front side is sloped along substantially an entire height of the body portion.

34. The ligature-resistant hinge cap of claim 25, wherein upper side of the body portion does not include a non-sloped surface.

35. A ligature-resistant hinge cap configured for use with a hinge including a pair of leaves and a connecting portion connecting the pair of leaves, the ligature-resistant hinge cap comprising:

a body portion comprising a base configured to cover an upper face of the connecting portion;

a flange extending rearward from the body portion;

a rear side defined by the flange; and a front side opposite the rear side, wherein the front side is sloped; and wherein the flange includes an extension that extends beyond the base.

* * * * *